US009020377B2

(12) United States Patent
Suzuki

(10) Patent No.: US 9,020,377 B2
(45) Date of Patent: Apr. 28, 2015

(54) IMAGE FORMING WITH ABNORMITY DETECTION

(75) Inventor: Soichiro Suzuki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 309 days.

(21) Appl. No.: 13/526,461

(22) Filed: Jun. 18, 2012

(65) Prior Publication Data

US 2013/0004188 A1 Jan. 3, 2013

(30) Foreign Application Priority Data

Jun. 30, 2011 (JP) ..... 2011-146478

(51) Int. Cl.
*G03G 15/00* (2006.01)
*G03G 15/01* (2006.01)

(52) U.S. Cl.
CPC ..... *G03G 15/5062* (2013.01); *G03G 15/0189* (2013.01); *G03G 2215/00042* (2013.01); *G03G 2215/0129* (2013.01); *G03G 2215/0164* (2013.01)

(58) Field of Classification Search
USPC ..... 399/39, 49, 15, 116
See application file for complete search history.

(56) References Cited

U.S. PATENT DOCUMENTS 7,310,483 B2 * 12/2007 Mizuno ..... 399/39

FOREIGN PATENT DOCUMENTS

JP 03134678 A * 6/1991
JP 2008-278215 11/2008

OTHER PUBLICATIONS translation JP2008-278215A.*

* cited by examiner

*Primary Examiner* — Quana M Grainger
(74) *Attorney, Agent, or Firm* — Fitzpatrick, Cella, Harper & Scinto

(57) ABSTRACT

An image forming apparatus which includes a color detection unit that emits a light to a color material and a reference plate on a printing material and detects the reflected light and corrects an amount of the color material upon image forming based on a detection result, comprises: a storage unit that stores, in advance, the detection result of each of the color material and the reference plate detected; and a blot detection unit that estimates the detection result for the reference plate based on a relationship between a stored reference value of each of the color material and the reference plate and the detection result of the color material, and if a difference between the estimated detection result and the detection result of the reference plate is larger than a predetermined value, detects presence of a blot.

20 Claims, 22 Drawing Sheets

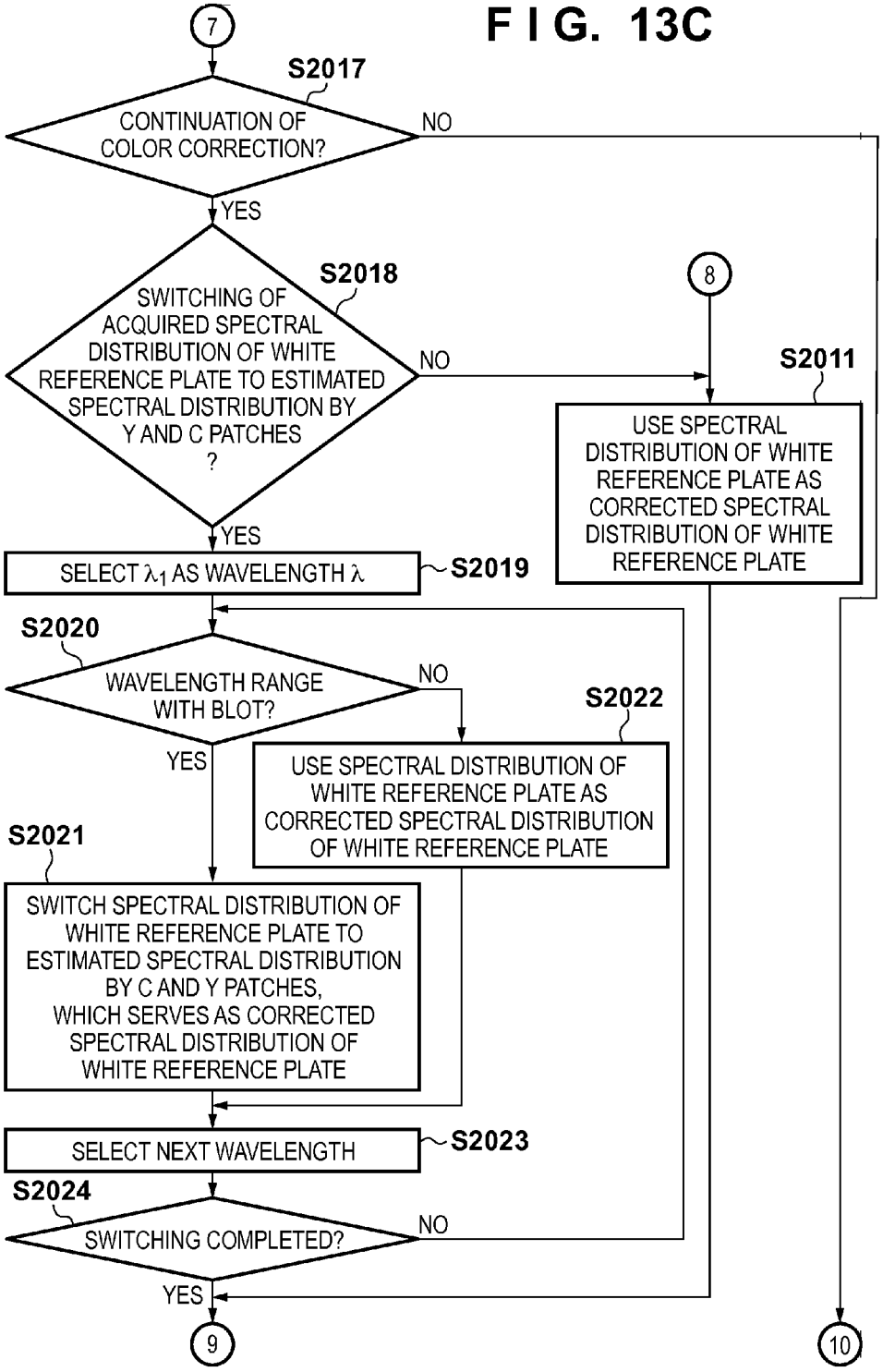
FIG. 13C
7
S2017
CONTINUATION OF COLOR CORRECTION?
NO
YES
S2018
SWITCHING OF ACQUIRED SPECTRAL DISTRIBUTION OF WHITE REFERENCE PLATE TO ESTIMATED SPECTRAL DISTRIBUTION BY Y AND C PATCHES ?
NO
8
S2011
USE SPECTRAL DISTRIBUTION OF WHITE REFERENCE PLATE AS CORRECTED SPECTRAL DISTRIBUTION OF WHITE REFERENCE PLATE
YES
SELECT λ1 AS WAVELENGTH λ
S2019
S2020
WAVELENGTH RANGE WITH BLOT?
NO
S2022
USE SPECTRAL DISTRIBUTION OF WHITE REFERENCE PLATE AS CORRECTED SPECTRAL DISTRIBUTION OF WHITE REFERENCE PLATE
YES
S2021
SWITCH SPECTRAL DISTRIBUTION OF WHITE REFERENCE PLATE TO ESTIMATED SPECTRAL DISTRIBUTION BY C AND Y PATCHES, WHICH SERVES AS CORRECTED SPECTRAL DISTRIBUTION OF WHITE REFERENCE PLATE
SELECT NEXT WAVELENGTH
S2023
S2024
SWITCHING COMPLETED?
NO
YES
9
10

FIG. 14

| PAPER TYPE No. (=PATCH No.) | FORMED PATCH | NUMBER OF TIMES OF TRANSFER | TRANSFER SURFACE |
|---|---|---|---|
| 1 | Y | 1 | ONE SURFACE |
| 2 | Y, C | 1 | BOTH SURFACES |
| 3 | Y, M, C | 2 | ONE SURFACE |
| 4 | Y, CM | 1 | ONE SURFACE |
| 5 | Y, M, C | 2 | BOTH SURFACES |

FIG. 16

*EACH α IS PRESET CORRECTION COEFFICIENT

| PAPER TYPE No. (=PATCH No.) | FORMED PATCH | NUMBER OF TIMES OF TRANSFER | TRANSFER SURFACE | BLOT PRESENCE/ABSENCE DETERMINATION THRESHOLD (T_err) | BLOT LEVEL DETERMINATION THRESHOLD (T_err_low, Terr_high) |
|---|---|---|---|---|---|
| 1 | Y | 1 | ONE SURFACE | T1y_err = Ty_err | T1_err_low = Ty_err_low<br>T1_err_high = Ty_err_high |
| 2 | Y | 1 | BOTH SURFACES | T2y_err = α2y * Ty_err | T2_err_low = α2y_low * Ty_err_low + α2c_low * Tc_err_low |
| | C | | | T2c_err = α2c * Tc_err | T2_err_high = α2y_high * Ty_err_high + α2c_high * Tc_err_high |
| 3 | Y | 2 | ONE SURFACE | T3y_err = α3y * Ty_err | T3_err_low = α3y_low * Ty_err_low + α3m_low * Tm_err_low + α3c_low * Tc_err_low |
| | M | | | T3m_err = α3m * Tc_err | T3_err_high = α3y_high * Ty_err_high + α3m_high * Tm_err_high + α3c_high * Tc_err_high |
| | C | | | T3c_err = α3c * Tc_err | |
| 4 | Y | 1 | ONE SURFACE | T4y_err = Ty_err | T4_err_low = α4y_low * Ty_err_low + α4m_low * Tm_err_low + α4c_low * Tc_err_low |
| | CM | | | T4cm_err = α4c * Tc_err + α4m * Tm_err | T4_err_high = α4y_high * Ty_err_high + α4m_high * Tm_err_high + α4c_high * Tc_err_high |
| 5 | Y | 2 | BOTH SURFACES | T5y_err = α5y * Ty_err | T5_err_low = α5y_low * Ty_err_low + α5m_low * Tm_err_low + α5c_low * Tc_err_low |
| | M | | | T5m_err = α5m * Tm_err | T5_err_high = α5y_high * Ty_err_high + α5m_high * Tm_err_high + α5c_high * Tc_err_high |
| | C | | | T5c_err = α5c * Tc_err | |

IMAGE FORMING WITH ABNORMITY DETECTION

BACKGROUND OF THE INVENTION

1. Field of the Invention

The present invention relates to an image forming apparatus that detects the density or color value of an image formed on a printing material and forms an image corresponding to the detection result, and a control method thereof.

2. Description of the Related Art

In recent years, a color image forming apparatus, such as a color printer or a color copying machine, is required to improve the quality of an output image. In particular, the tone of the density of an output image and its stability are important factors to decide the image quality.

However, the color image forming apparatus changes the density or tint of an output image due to environmental variations or variation factors of various units of the apparatus caused by long-term use. In particular, an electrophotographic color image forming apparatus may change the density or tint of an output image due to slight environmental variations and disturb the image forming characteristics, and therefore needs to include a method for always maintaining a predetermined density. One such method uses a sensor (to be referred to as a "color sensor" hereinafter) for detecting a color value. More specifically, the color value of each color toner image (to be referred to as a "patch" hereinafter) formed and fixed on a printing material for color value detection is detected by a color sensor, and the amount of a toner to be transferred to the printing material is adjusted/corrected based on the detection result.

When detecting the color value of a patch using the color sensor, it is necessary to detect the color value (white reference) of white serving as a reference using a white reference plate, and to calibrate the color sensor output based on the detection result. This is because, for example, the time degradation of the light-emitting unit or the light-receiving unit of the color sensor, a change in the ambient temperature, and dust or toners adhering to the sensor surface at the time of passage of the printing material near the sensor causes the sensor output to vary even for the same patch. When detecting the color value of a patch, the white reference is acquired using the white reference plate, and the patch detection result is corrected using the acquired white reference, thereby acquiring the color value of the patch independently of the change in the sensor output value.

However, like the sensor, the white reference plate cannot be used as a reference plate for sensor output calibration if dust or toners are adhering to it. To solve this problem, Japanese Patent Laid-Open No. 2008-278215 describes a method of detecting a blot on the white reference plate by causing the color sensor to detect the color value of specific reference paper that has a known color value. In this method, the color value of the reference paper detected by the sensor calibrated using the white reference plate is compared with the known color value of the reference paper, thereby detecting a blot on the white reference plate.

However, the conventional method needs to always use the reference paper which has a known color value. If paper whose color value is different from the known color value of the reference paper—such as paper other than the reference paper or blotted reference paper—is used, the blot on the white reference plate cannot properly be detected, and color correction cannot properly be performed.

SUMMARY OF THE INVENTION

The present invention provides an image forming apparatus capable of properly detecting a blot on a white reference plate and performing color correction using a simple arrangement without the reference paper having a known color value.

According to one aspect of the present invention, there is provided an image forming apparatus which includes a color detection unit that emits a light to a color material and a reference plate on a printing material and detects the light reflected by the color material and the reference plate, and corrects an amount of the color material upon image forming based on a detection result of the color detection unit, comprising: a storage unit configured to store, in advance, the detection result of each of the color material and the reference plate detected by the color detection unit; and a blot detection unit configured to estimate the detection result for the reference plate based on a relationship between a reference value of each of the color material and the reference plate stored in the storage unit and the detection result of the color material by the color detection unit, and if a difference between the estimated detection result and the detection result of the reference plate by the color detection unit is larger than a predetermined value, to detect presence of a blot on the reference plate.

According to another aspect of the present invention, there is provided a control method of an image forming apparatus which includes a color detection unit that emits a light to a color material and a reference plate on a printing material and detects the light reflected by the color material and the reference plate, and corrects an amount of the color material upon image forming based on a detection result of the color detection unit, comprising the steps of: storing, in a storage unit in advance, the detection result of each of the color material and the reference plate detected by the color detection unit; and estimating the detection result for the reference plate based on a relationship between a reference value of each of the color material and the reference plate stored in the storage unit and the detection result of the color material by the color detection unit, and if a difference between the estimated detection result and the detection result of the reference plate by the color detection unit is larger than a predetermined value, detecting presence of a blot on the reference plate.

According to the present invention, it is possible to provide an image forming apparatus capable of stably detecting a blot on a reference plate without using reference paper which has a known color value.

Further features of the present invention will become apparent from the following description of exemplary embodiments (with reference to the attached drawings).

BRIEF DESCRIPTION OF THE DRAWINGS

FIGS. 13A, 13B, 13C, and 13D are flowcharts of a color correction sequence according to the second embodiment;

FIG. 14 is a table showing an example of formed patches according to the type of a printing material according to the third embodiment;

FIG. 16 is a table showing an example of thresholds to be used to determine a blot on a white reference plate based on the type of the printing material according to the third embodiment.

DESCRIPTION OF THE EMBODIMENTS

<First Embodiment>

[Device Arrangement]

Figure 2:
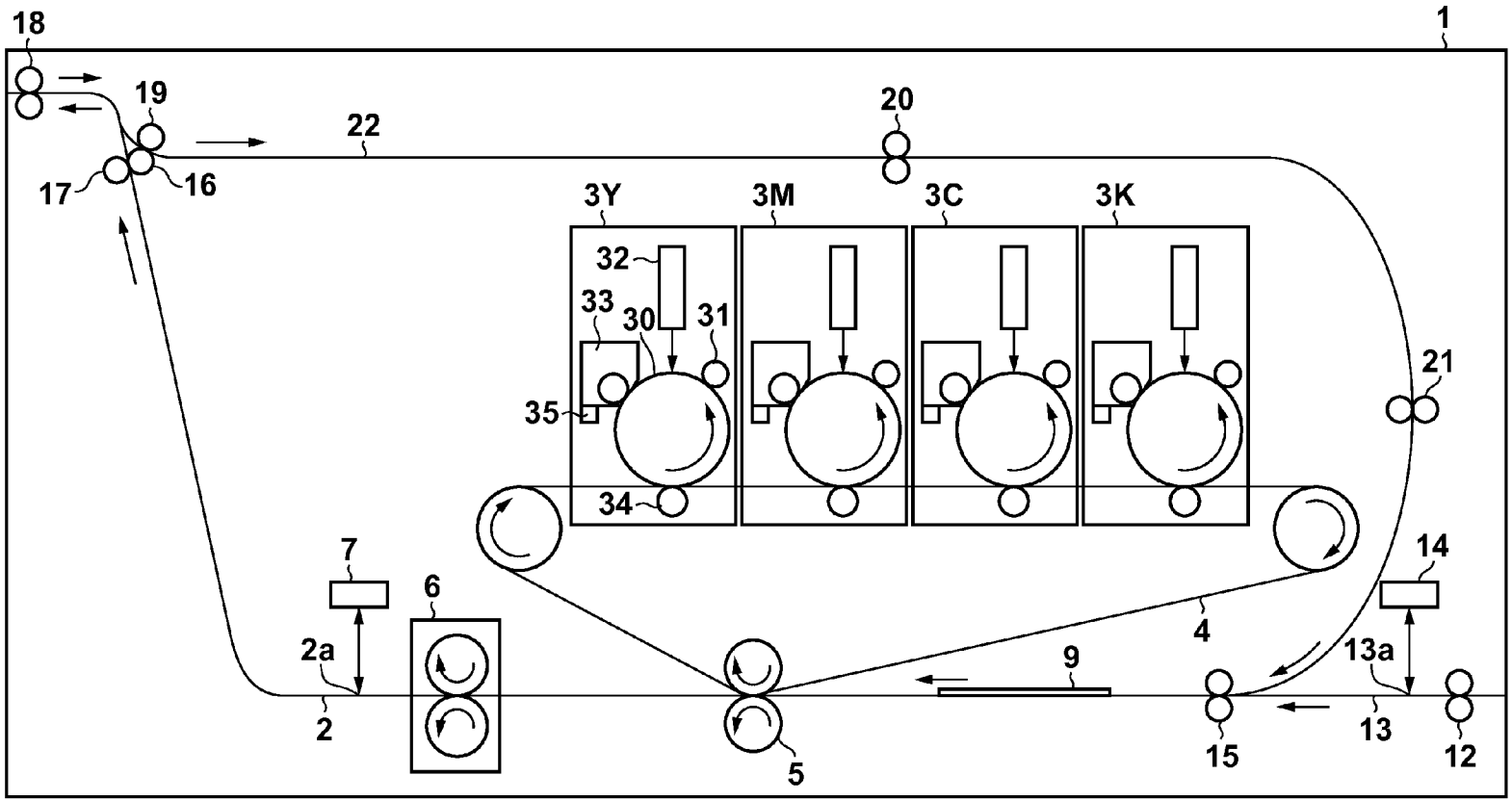
FIG. 2 is a sectional view showing the schematic arrangement of an image forming apparatus.

An image forming apparatus according to the first embodiment of the present invention will be described. FIG. 2 illustrates a color image forming apparatus employing an electrophotographic method, which is an example of the image forming apparatus according to the embodiment of the present invention. An image forming apparatus 1 causes feed unit conveyance rollers 12 and 15 to convey a printing material 9 which is fed from a feed unit (not shown). A media sensor 14 detects the type of the conveyed printing material 9 at a detection position 13*a* on a feed unit conveyance path 13. The image forming apparatus 1 includes an intermediate transfer material 4, image forming units 3Y, 3M, 3C, and 3K, a secondary transfer unit 5, a fixing unit 6, and a color sensor 7. The image forming units 3Y, 3M, 3C, and 3K form toner images on the intermediate transfer material 4 using yellow (Y), magenta (M), cyan (C), and black (K) toners (color materials), respectively. The secondary transfer unit 5 transfers the toner images on the intermediate transfer material 4 to the conveyed printing material 9. The fixing unit 6 fixes the toner images on the printing material 9. The color sensor 7 serves as a color detection unit and detects the color of the toner image formed and fixed on the printing material 9 at a detection position 2*a* on a fixing unit conveyance path 2.

The image forming units 3Y, 3M, 3C, and 3K have the same arrangement, and each includes a photosensitive drum 30, a charger 31, an exposure unit 32, a developing unit 33, and a primary transfer unit 34. The photosensitive drum 30 is rotated by a driving motor (not shown). The charger 31 uniformly charges the surface of the photosensitive drum 30. The exposure unit 32 exposes the surface of the uniformly discharged photosensitive drum 30 based on the image signal of the corresponding color so as to form an electrostatic latent image. The developing unit 33 develops the electrostatic latent image formed on the surface of the photosensitive drum 30 using the toner of the corresponding color. The primary transfer unit 34 transfers the developed toner image on the photosensitive drum 30 to the intermediate transfer material 4. The developing unit 33 includes memory 35. The memory 35 stores information unique to the developing unit 33, for example, a manufacturing variation in the fixing property of the toner contained in the developing unit 33 to the printing material 9.

The printing material 9 with the toner image fixed on it is discharged via discharge unit rollers 16 and 17 and switchback rollers 18. To transfer toner images on both surfaces of the printing material 9, the switchback rollers 18 and the discharge unit rollers 16 and 19 rotate in reverse directions after the trailing edge of the printing material 9 has passed through the discharge unit rollers 16 and 17, thereby conveying the printing material 9 to a backward conveyance path 22. The printing material 9 conveyed to the backward conveyance path 22 is conveyed in a turned state via backward conveyance rollers 20 and 21 and the feed unit conveyance rollers 15. The secondary transfer unit 5 transfers toner images, thereby transferring the toner images to the reverse surface of the printing material 9.

[Control Mechanism]

Figure 3:
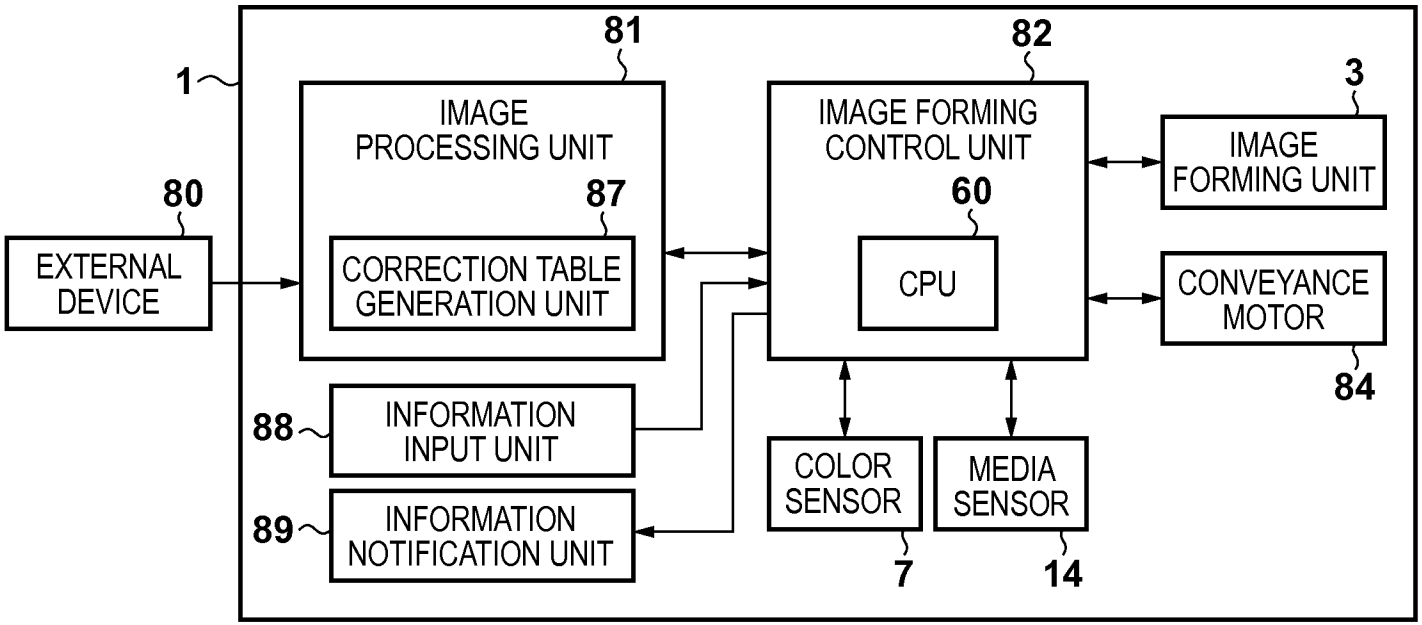
FIG. 3 is a block diagram showing a simplified control arrangement of the image forming apparatus.

FIG. 3 is a block diagram showing a simplified control arrangement of the image forming apparatus 1 according to this embodiment. The image forming apparatus 1 receives an image signal (RGB signals) from an external device 80 such as a personal computer (PC) communicably connected to the image forming apparatus 1. An image processing unit 81 converts the received RGB signals into CMYK signals and causes a correction table generation unit 87 to correct the density and tone characteristics, thereby generating an image signal for the exposure unit 32 shown in FIG. 2. The color material amounts (toner amounts) are adjusted by the correction value used here.

An image forming control unit 82 includes a CPU 60. The CPU 60 controls the timing of each operation concerning image forming and communication between the devices. The image forming control unit 82 controls the image forming unit 3 of each color and forms a toner image based on the image signal generated by the image processing unit 81. A conveyance motor 84 serves as a driving unit that conveys the printing material 9 in the image forming apparatus 1 at a predetermined timing in accordance with an instruction from the image forming control unit 82. In this embodiment, the printing material 9 is conveyed by a plurality of driving units (not shown). The image forming control unit 82 controls the conveyance speed of the printing material 9 in accordance with its type detected by the media sensor 14 so as to fix an optimum amount of toner.

The color sensor 7 detects the spectral distribution of a patch pattern formed on the printing material 9 upon receiving an instruction from the image forming control unit 82. The image forming control unit 82 calculates the color value of the patch pattern based on its spectral distribution detected by the color sensor 7 and feeds back the calculated color value to the correction table generation unit 87 of the image processing unit 81, thereby performing color correction. The start of color correction processing is instructed by the user via an information input unit 88. The user is notified of the color correction execution result by an information notification unit 89. Note that the user may be notified of the color correction execution result via the external device 80.

[Color Sensor]

Figure 4:
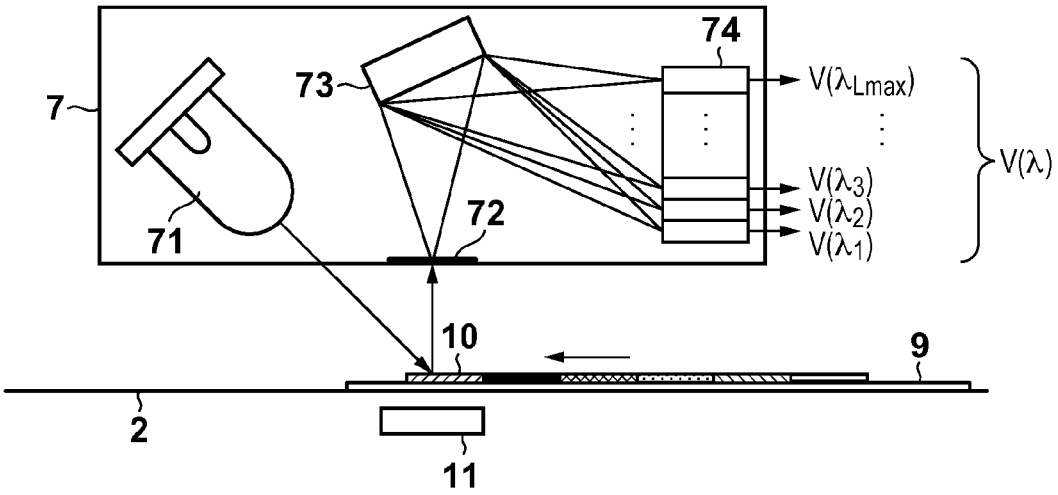
FIG. 4 is a view showing the arrangement of a color sensor.
Figure 5:
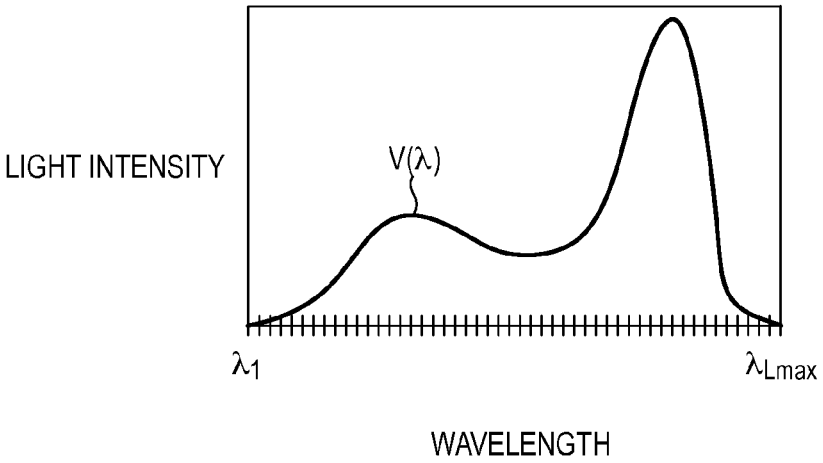
FIG. 5 is a graph showing an example of the spectral distribution of a patch detected by the color sensor.

FIG. 4 is an enlarged view of the detection position 2*a* shown in FIG. 2 of the color sensor 7 according to this embodiment and the arrangement of the color sensor 7. FIG. 5 shows an example of the spectral distribution of a patch detected by the color sensor 7. The color sensor 7 is arranged to face the image forming surface of the printing material 9 so as to detect the spectral distribution of a fixed toner image.

The color sensor 7 is configured to detect the spectral distribution of a color correction patch pattern 10 formed and fixed on the printing material 9 while conveying the printing material 9. A white reference plate 11 is provided on the opposite surface viewed from the color sensor 7 at the detection position 2*a*. That is, the color sensor 7 and the white reference plate 11 face each other, and the printing material 9 is conveyed between them.

The color sensor 7 includes a white LED 71, a slit 72, a reflective diffraction grating 73, and a line sensor 74 including a plurality of light-receiving units arranged in a line. The white LED 71 obliquely inputs light at 45° with respect to the printing material 9 on which the color correction patch pattern 10 is formed and fixed. The slit 72 passes the light reflected by the patch and input at 90° with respect to the surface of the printing material 9. The diffraction grating 73 spectrally splits the light reflected by the patch and passed through the slit 72 into light components corresponding to wavelengths. In the line sensor 74, each light-receiving unit detects the intensity of light corresponding to the split wavelength. Let $V(\chi)$ be the light intensity at a wavelength $\chi$ within a detection range from $\lambda 1$ to $\lambda Lmax$ [nm] (Lmax: the total number of light-receiving units). The spectral distribution is represented by $V(\lambda)$ ($\lambda=\lambda 1, \ldots, \lambda L, \ldots, \lambda Lmax$).

[Color Sensor Output Value Calibration Method]

Figure 6:
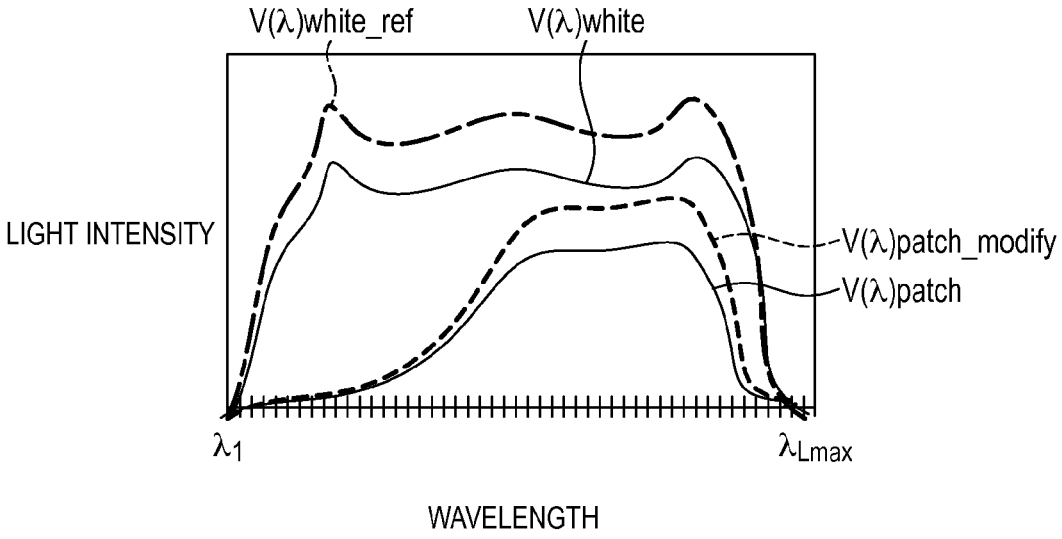
FIG. 6 is a graph for explaining a color sensor output value calibration method using a white reference plate.

FIG. 6 is a graph for explaining a color sensor output value calibration method using a white reference plate 11 when correcting the color material amount. When calculating the color value of the color correction patch pattern 10 on the printing material 9 using the color sensor 7, the spectral distribution of the white reference plate 11 detected by the white reference plate 11 is first set as a white reference. The color value of the color correction patch pattern 10 is calculated from the white reference and the spectral distribution of the color correction patch pattern 10 detected by the color sensor 7. Detection of the spectral distribution of the white reference plate 11 needs to be done every time color correction is executed. This is because, for example, the time degradation of the light-emitting unit or the light-receiving units of the color sensor 7, a change in the ambient temperature, and dust or toners adhered to the sensor surface at the time of passage of the printing material 9 near the sensor make the output of the color sensor 7 vary even when the same color correction patch pattern 10 is used.

$V(\lambda)$white_ref in FIG. 6 is the spectral distribution of the white reference plate 11 detected by the color sensor 7 at the time of shipment of the image forming apparatus. That is, it is the spectral distribution of the white reference plate 11 detected by the color sensor 7 without blots adhered. $V(\lambda)$white is the spectral distribution of the white reference plate 11 detected by the color sensor 7 with time degradation, toner adhesion, or the like at the time of color correction after shipment of the image forming apparatus. $V(\lambda)$patch is the spectral distribution of a patch detected by the color sensor 7 with time degradation, toner adhesion, or the like at the time of color correction after shipment of the image forming apparatus. To calculate the color value of the patch, its spectral distribution detected by the color sensor 7 without time degradation, toner adhesion, or the like is necessary.

When the color sensor 7, with time degradation, toner adhesion, or the like is used, the spectral distribution of the white reference plate 11 and that of the patch are affected similarly. That is, the rate of decrease of the light intensity of the spectral distribution caused by the color sensor 7 with time degradation, toner adhesion, or the like is the same in the white reference plate 11 and the patch. For this reason, letting $V(\lambda)$patch_ref be the spectral distribution of the patch detected by the color sensor 7 at the time of shipment of the image forming apparatus, $$V(\lambda)\text{white}/V(\lambda)\text{white_ref}=V(\lambda)\text{patch}/V(\lambda)\text{patch_ref} \quad (1)$$

holds.

Hence, using $V(\lambda)$white, $V(\lambda)$white_ref, and $V(\lambda)$patch, a spectral distribution $V(\lambda)$patch_modify of the patch detected by the color sensor 7 without time degradation, toner adhesion, or the like can be calculated by $$V(\lambda)\text{patch_modify}=V(\lambda)\text{patch}\times(V(\lambda)\text{white_ref}/V(\lambda)\text{white}) \quad (2)$$

For the calculated spectral distribution $V(\lambda)$patch_modify, the difference between the color value of the white reference plate 11 and that of the detected white is further corrected, thereby calculating the color value of the patch detected by the color sensor 7 without time degradation, toner adhesion, or the like. The spectral distribution of the white reference plate 11 is thus detected every time color correction is executed. This enables color correction to be properly performed even when using the color sensor 7 with time degradation, toner adhesion, or the like.

However, if for some reason the white reference plate 11 is blotted, the white reference value cannot properly be acquired, and color correction cannot properly be performed. When reference paper which has a known color value is used, a blot on the white reference plate 11 can be detected. In this case, however, reference paper which has a known color value must always be used. If paper which has a color value different from that of the reference paper is used, the blot on the white reference plate 11 cannot properly be detected.

In this embodiment, a blot detection patch using toner of a large bearing amount is formed on a paper sheet (printing material 9). The spectral distribution of the blot detection patch is detected by the color sensor 7, thereby detecting a blot on the white reference plate 11. When the blot detection patch using toner of a large bearing amount is formed, spectral distribution of the blot detection patch is hardly affected by the blot or thinness of the paper sheet. It is therefore possible to stably acquire spectral distribution independently no matter what the type of the paper sheet. In addition, since the spectral distribution of the blot detection patch can stably be detected, color correction is performed using the spectral distribution of the blot detection patch if the white reference plate 11 is badly blotted. This allows to perform more accurate color correction than that using the blotted white reference plate 11.

Figure 7:
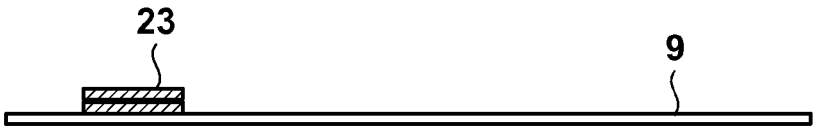
FIG. 7 is a view showing a patch to be used to detect a blot on the white reference plate according to the first embodiment.

In this embodiment, a double transfer Y patch 23 formed by transferring a Y toner image formed by the image forming unit 3Y in FIG. 2 twice onto the printing material 9 in a superimposed manner, as shown in FIG. 7, is used as the blot detection patch. Hence, only one type of patch formed by superimposing only the Y color toner a plurality of times is used. When conveyance of the printing material 9 is repeated twice using the switchback rollers 18 and the discharge unit rollers 16 and 19 in FIG. 2, the printing material 9 is turned twice. Hence, the patch can be transferred to the same portion of the printing material 9 twice in a superimposed manner. Transferring the patch twice makes it possible to transfer a larger amount of toner to the printing material 9. For this reason, the spectral distribution of the patch is hardly affected even when paper having a different color value, thinness, or toner fixing property is used. It is therefore possible to stably acquire the spectral distribution of the patch.

[Blot Detection Method and Color Correction Method]

Figure 8A:
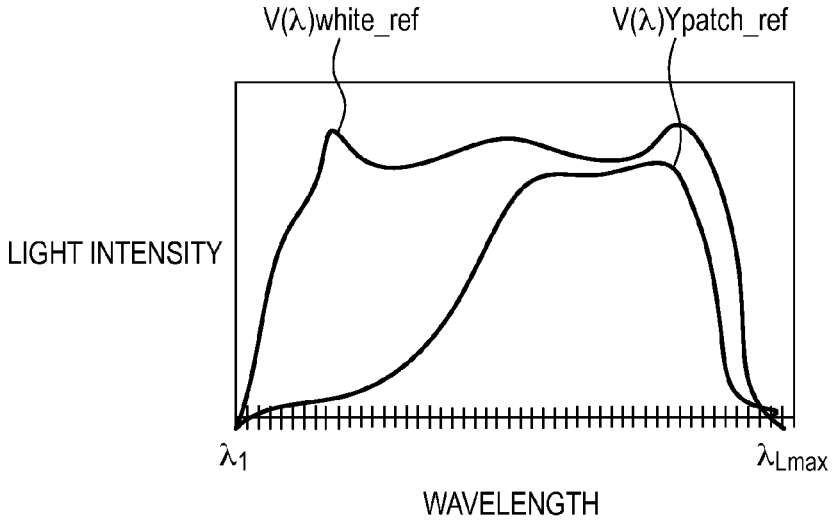
FIGS. 8A and 8B are graphs showing examples of the spectral distributions of the white reference plate and the patch according to the first embodiment when the white reference plate is blotted.

The blot detection method and the color correction method of the white reference plate 11 according to this embodiment will be described with reference to FIGS. 8A and 8B. V(λ)white_ref and V(λ)Ypatch_ref shown in FIG. 8A are the spectral distribution of the white reference plate 11 and that of the double transfer Y patch 23, respectively, detected by the color sensor 7 and stored at the time of shipment of the image forming apparatus. These pieces of information are stored in a ROM 100 serving as a storage unit in the image forming apparatus 1.

Figure 8B:
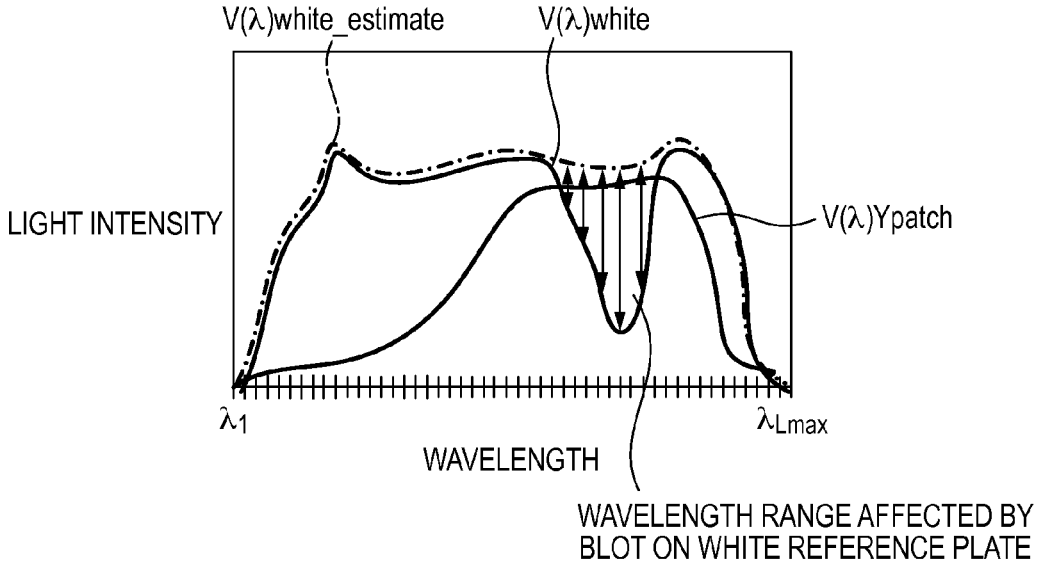

V(λ)white and V(λ)Ypatch shown in FIG. 8B are the spectral distribution of the white reference plate 11 and that of the double transfer Y patch 23, respectively, detected by the color sensor 7 with time degradation, toner adhesion, or the like at the time of color correction execution after shipment of the image forming apparatus. As shown in FIG. 8B, if time degradation, toner adhesion, or the like has occurred in the color sensor 7 after shipment of the image forming apparatus, the light intensities of the spectral distributions of the white reference plate 11 and the double transfer Y patch 23 at a lower rate.

However, if the decease in light intensity is caused by the time degradation or toner adhesion of the color sensor 7, the spectral distributions of the white reference plate 11 and the double transfer Y patch 23 are affected similarly. That is, when the white reference plate 11 is not blotted, the decrease rate of V(λ)white to V(λ)white_ref and the decrease rate of V(λ)Ypatch to V(λ)Ypatch_ref almost equal. Hence, if there is a wavelength range where the decrease rate of V(λ)white is higher than that of V(λ)Ypatch, the white reference plate 11 can be determined to be blotted.

In this embodiment, an estimated spectral distribution V(λ)white_estimate of the white reference plate 11 is obtained from the spectral distribution of the double transfer Y patch 23 detected by the color sensor 7 and the spectral distributions of the white reference plate 11 and the double transfer Y patch 23 at the time of shipment of the image forming apparatus. In this embodiment, a blot on the white reference plate 11 is detected by $$V(\lambda)\text{white_estimate}=V(\lambda)\text{Ypatch}\times(V(\lambda)\text{white_ref}/V(\lambda)\text{Ypatchref}) \quad (3)$$

In this embodiment, the estimated spectral distribution V(λ)white_estimate of the white reference plate 11 is compared with the spectral distribution V(λ)white of the white reference plate 11 detected by the color sensor 7 for each wavelength range. A wavelength range where the difference is larger than a blot presence/absence determination threshold Terr that is a predetermined value set in advance is determined to be affected by a blot on the white reference plate 11. Hence, if the estimated spectral distribution and the spectral distribution of the white reference plate detected by the color sensor 7 have a difference for each wavelength range, the color value calculated from the estimated spectral distribution and the color value calculated from the spectral distribution of the white reference plate detected by the color sensor 7 also have a difference. If the color value difference is equal to or larger than the color value detection accuracy of the color sensor 7, the white reference plate 11 can be determined to be blotted.

In this embodiment, the value of a wavelength range difference by which the color value difference becomes equal to or larger than the color value detection accuracy of the color sensor 7 is set as the blot presence/absence determination threshold. As the blot presence/absence determination threshold Terr, a value that changes depending on the developing unit is set in consideration of the manufacturing variation in the fixing property of the Y patch to the printing material 9. In this embodiment, if at least one wavelength range is affected by the blot, the user is notified of the blot on the white reference plate 11 and requested to exchange or clean the white reference plate 11.

In addition, the wavelength range-specific differences between V(λ)white_estimate and V(λ)white are totaled, and the user is notified of the degree of blot on the white reference plate 11 in accordance with the magnitude of the sum. In this embodiment, the user is notified of the degree of blot in three levels using two blot level determination thresholds Terr_high and Terr_low (Terr_high>Terr_low) that are predetermined values set in advance.

level 1:

$$\Sigma(V(\lambda)\text{white_estimate}-V(\lambda)\text{white})\leq\text{Terr_low}$$

level 2:

$$\text{Terr_low}<\Sigma(V(\lambda)\text{white_estimate}-V(\lambda)\text{white})<\text{Terr_high}$$

level 3:

$$\text{Terr_high}\leq\Sigma(V(\lambda)\text{white_estimate}-V(\lambda)\text{white}) \quad (4)$$

where Σ is the sum at λ=λ1 to λLmax.

Values considering the influence of the sum of wavelength range-specific differences on the difference between the color value calculated from V(λ)white_estimate and that calculated from V(λ)white are set as the blot level determination thresholds used here. Note that in this embodiment, the blot presence/absence determination threshold Terr and the blot level determination thresholds Terr_high and Terr_low are stored in the memory 35 in advance.

When, for example, the white reference plate is difficult to replace or clean, and the user gives the instruction to perform color correction using the double transfer Y patch 23 in the state in which the white reference plate is blotted, color correction is done by switching the value of the spectral distribution to the value of the estimated spectral distribution of the white reference plate estimated from the double transfer Y patch 23. At this time, for a wavelength range that is affected by the blot, a corrected spectral distribution V(λ)white_modify is calculated using the estimated spectral distribution V(λ)white_estimate of the white reference plate 11. For a wavelength range that is not affected by the blot, the corrected spectral distribution V(λ)white_modify is calculated using the spectral distribution V(λ)white of the white reference plate 11 detected by the color sensor 7.

From the corrected spectral distribution V(λ)white_modify of the white reference plate 11 and the spectral distribution V(λ)patch of the color correction patch pattern 10 detected by the color sensor 7, the V(λ)patch_modify of the color correction patch pattern 10 detected by the color sensor 7 without time degradation, toner adhesion, or the like is calculated by $$V(\lambda)\text{patch_modify}=V(\lambda)\text{patch}\times(V(\lambda)\text{white_ref}/V(\lambda)\text{white_modify}) \quad (5)$$

The difference between the color value of the white reference plate 11 and the color value of white is corrected for the calculated corrected spectral distribution V(λ)patch_modify of the color correction patch pattern 10, thereby calculating the color value of the color correction patch pattern 10. With this control, when the white reference plate 11 is badly blotted, using the spectral distribution of the double transfer Y patch 23 enables to perform more accurate color correction than that using the blotted white reference plate 11.

[Arrangement of Color Correction System]

Figure 1:
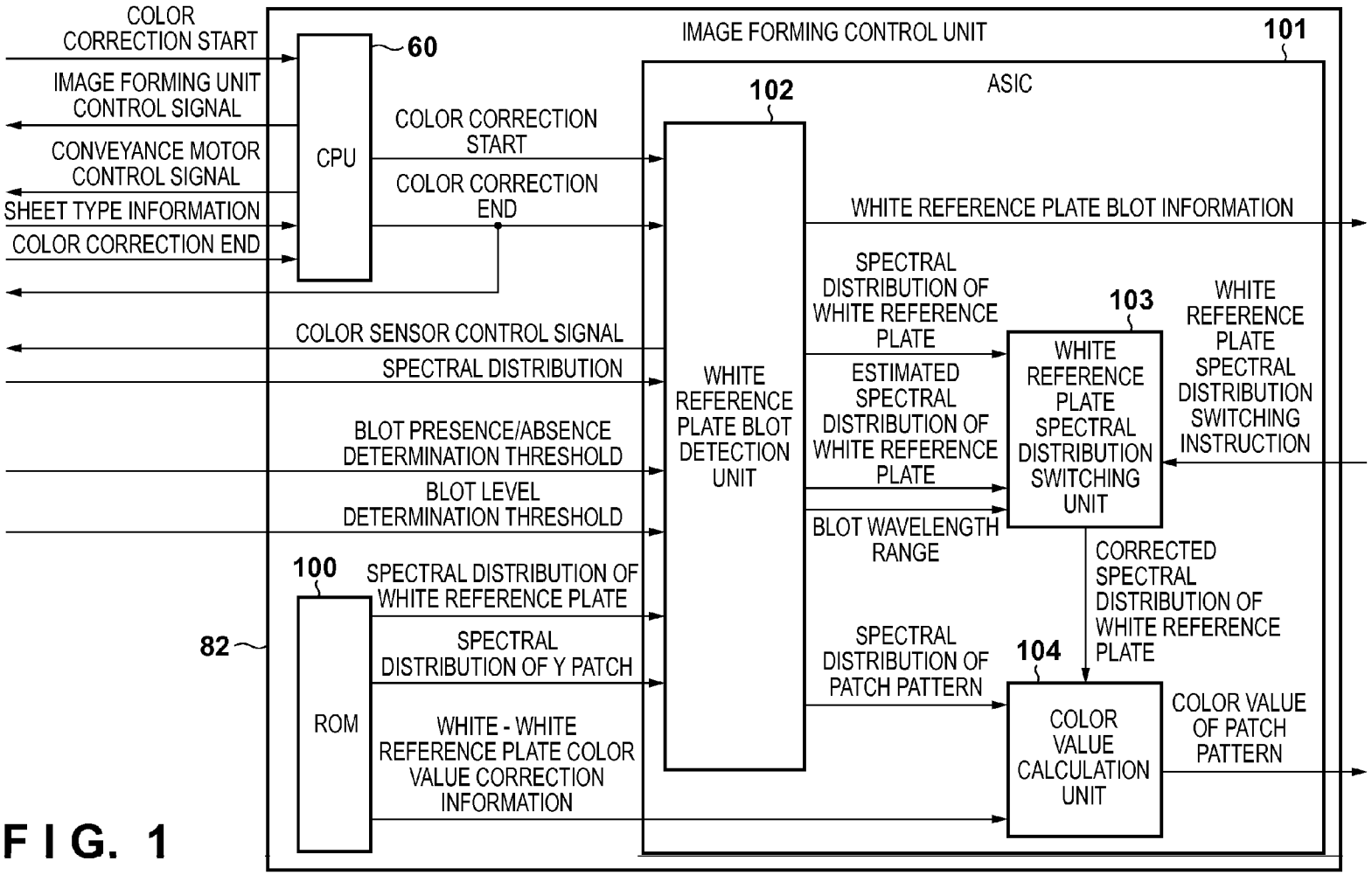
FIG. 1 is a block diagram of a color correction system according to the first embodiment.

FIG. 1 is a block diagram showing an example of the arrangement of a color correction system according to this embodiment. Upon receiving a color correction start instruction from the user via the information input unit 88 in FIG. 3, the CPU 60 of the image forming control unit 82 controls the image forming unit 3 and the conveyance motor 84 to form the double transfer Y patch 23 and the color correction patch pattern 10 on the printing material 9. The CPU 60 also controls the conveyance speed of the printing material 9 so as to fix an optimum amount of toner in accordance with the type of the printing material 9 detected by the media sensor 14.

Upon receiving the color correction start instruction from the CPU 60, a white reference plate blot detection unit 102 in an ASIC 101 controls the color sensor 7 to acquire the spectral distributions of the white reference plate 11, the double transfer Y patch 23, and the color correction patch pattern 10 sequentially as detection results. A ROM 100 stores the spectral distributions of the white reference plate 11 and the double transfer Y patch 23 detected by the color sensor 7 at the time of shipment of the image forming apparatus and information to be used to correct the difference between the color value of the white reference plate 11 and that of white.

The white reference plate blot detection unit 102 receives the blot presence/absence determination threshold Terr and the blot level determination thresholds Terr_high and Terr_low which are values that take into consideration the toner fixing properties, manufacturing variations, and the like, and are stored in the memory 35 provided in each developing unit 33 shown in FIG. 2. The white reference plate blot detection unit 102 calculates the estimated spectral distribution of the white reference plate 11 from the spectral distribution of the double transfer Y patch 23 detected by the color sensor 7 and the spectral distributions of the white reference plate 11 and the double transfer Y patch 23 stored in the ROM 100. The white reference plate blot detection unit 102 determines the presence/absence of a blot on the white reference plate and the degree of blot based on the estimated spectral distribution of the white reference plate 11, the spectral distribution of the white reference plate 11 detected by the color sensor 7, the blot presence/absence determination threshold, and the blot level determination thresholds. The white reference plate blot detection unit 102 then notifies the user of the white reference plate blot information via the information notification unit 89 shown in FIG. 3.

The white reference plate blot detection unit 102 outputs the estimated spectral distribution of the white reference plate 11, the spectral distribution of the white reference plate 11 detected by the color sensor 7, and the information of the wavelength ranges affected by the blot to a white reference plate spectral distribution switching unit 103. The user can determine whether to continue color correction based on the white reference plate blot information notified by the information notification unit 89 and instruct the CPU 60 via the information input unit 88 to end or continue color correction. To continue color correction, the user can instruct the white reference plate spectral distribution switching unit 103 via the information input unit 88 whether to switch the spectral distribution of the white reference plate 11 detected by the color sensor 7 to the estimated spectral distribution of the white reference plate to execute the color correction.

Upon receiving the switching instruction, the white reference plate spectral distribution switching unit 103 outputs, for a wavelength range that is affected by the blot, the estimated spectral distribution of the white reference plate estimated from the double transfer Y patch 23 to a color value calculation unit 104 as the corrected spectral distribution of the white reference plate. Similarly, for a wavelength range that is not affected by the blot, the white reference plate spectral distribution switching unit 103 outputs the spectral distribution of the white reference plate detected by the color sensor 7 to the color value calculation unit 104 as the corrected spectral distribution of the white reference plate. When no switching instruction is received, the white reference plate spectral distribution switching unit 103 outputs the spectral distribution of the white reference plate detected by the color sensor 7 to the color value calculation unit 104 as the corrected spectral distribution of the white reference plate. The white reference plate blot detection unit 102 outputs the spectral distribution of the color correction patch pattern 10 detected by the color sensor 7 to the color value calculation unit 104.

The color value calculation unit 104 calculates the color value of the color correction patch pattern 10 from the corrected spectral distribution of the white reference plate output from the white reference plate spectral distribution switching unit 103, the spectral distribution of the color correction patch pattern output from the white reference plate blot detection unit 102, and the ratio information between the color value of the white reference plate 11 and that of white stored in the ROM 100 in advance. The color value calculation unit 104 outputs the calculated color value of the color correction patch pattern 10 to the image processing unit 81 shown in FIG. 3. The image processing unit 81 reflects the color value of the color correction patch pattern 10 on the correction table generation unit 87 and notifies the CPU 60 of the end of color correction. When notified of the end of color correction, the CPU 60 instructs the white reference plate blot detection unit 102 to end color correction and notifies the user of the end of color correction via the information notification unit 89.

[Color Correction Processing]

Figure 9A:
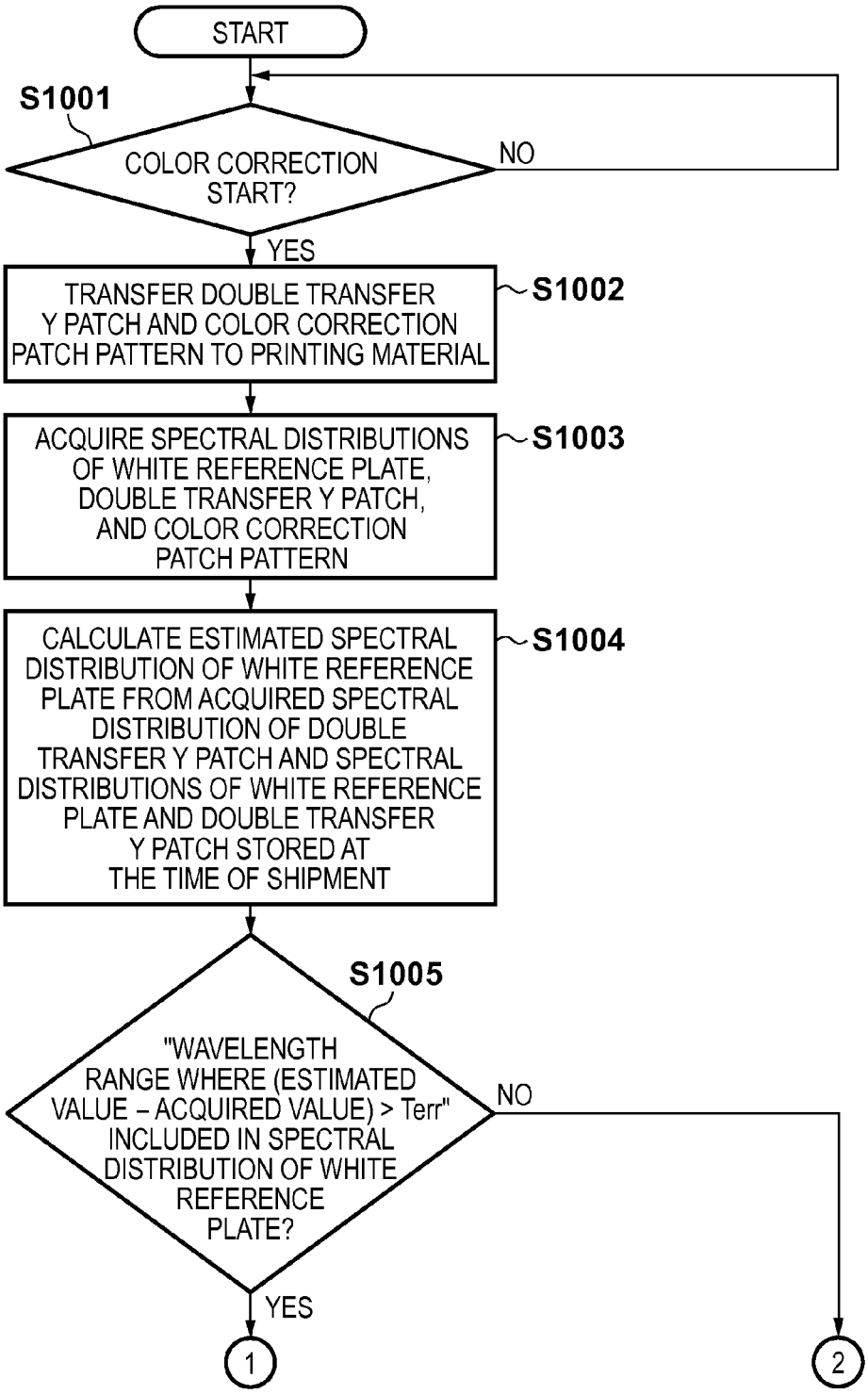
FIGS. 9A, 9B, and 9C are flowcharts of a color correction sequence according to the first embodiment.
Figure 9B:
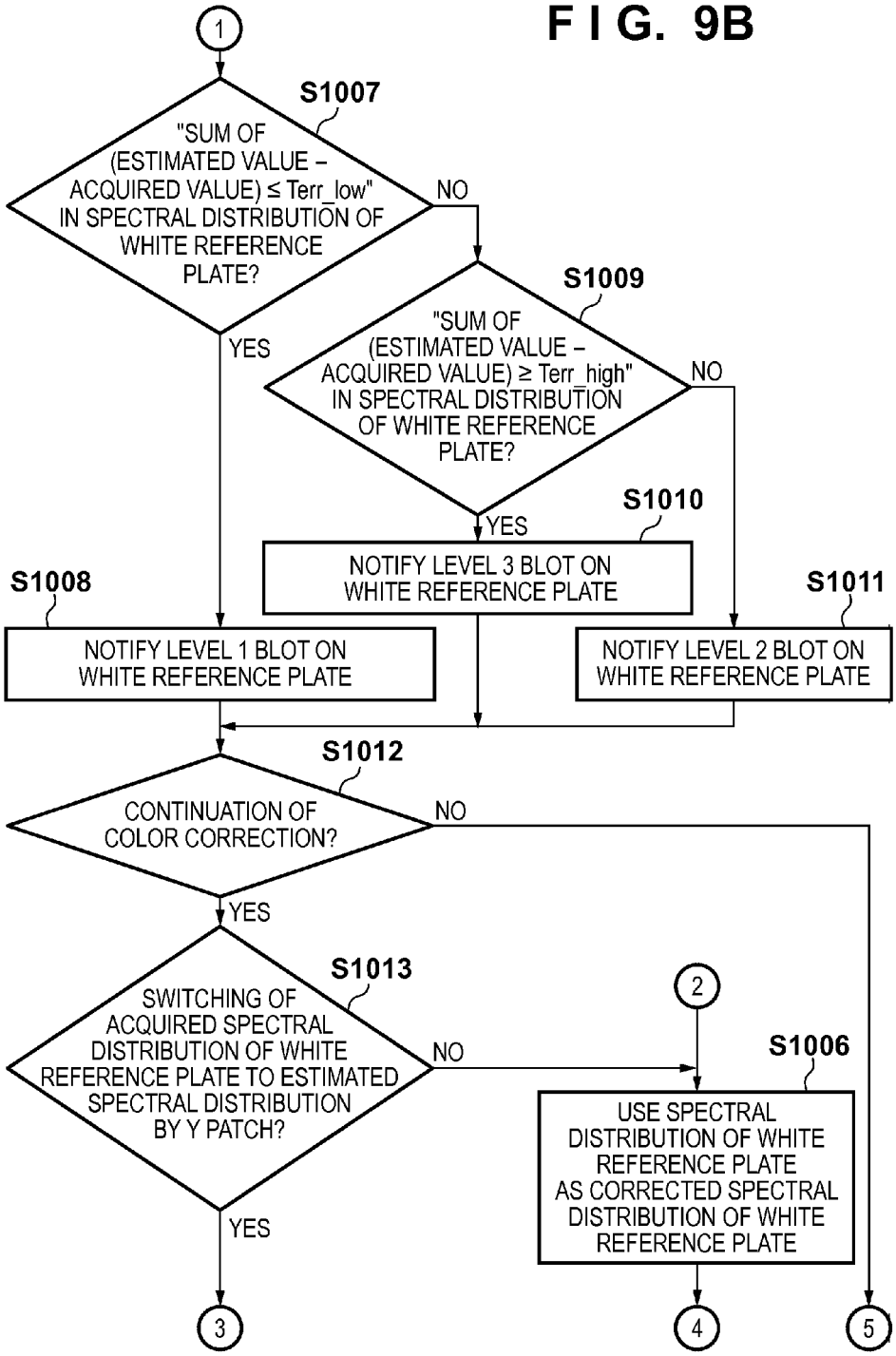
Figure 9C:
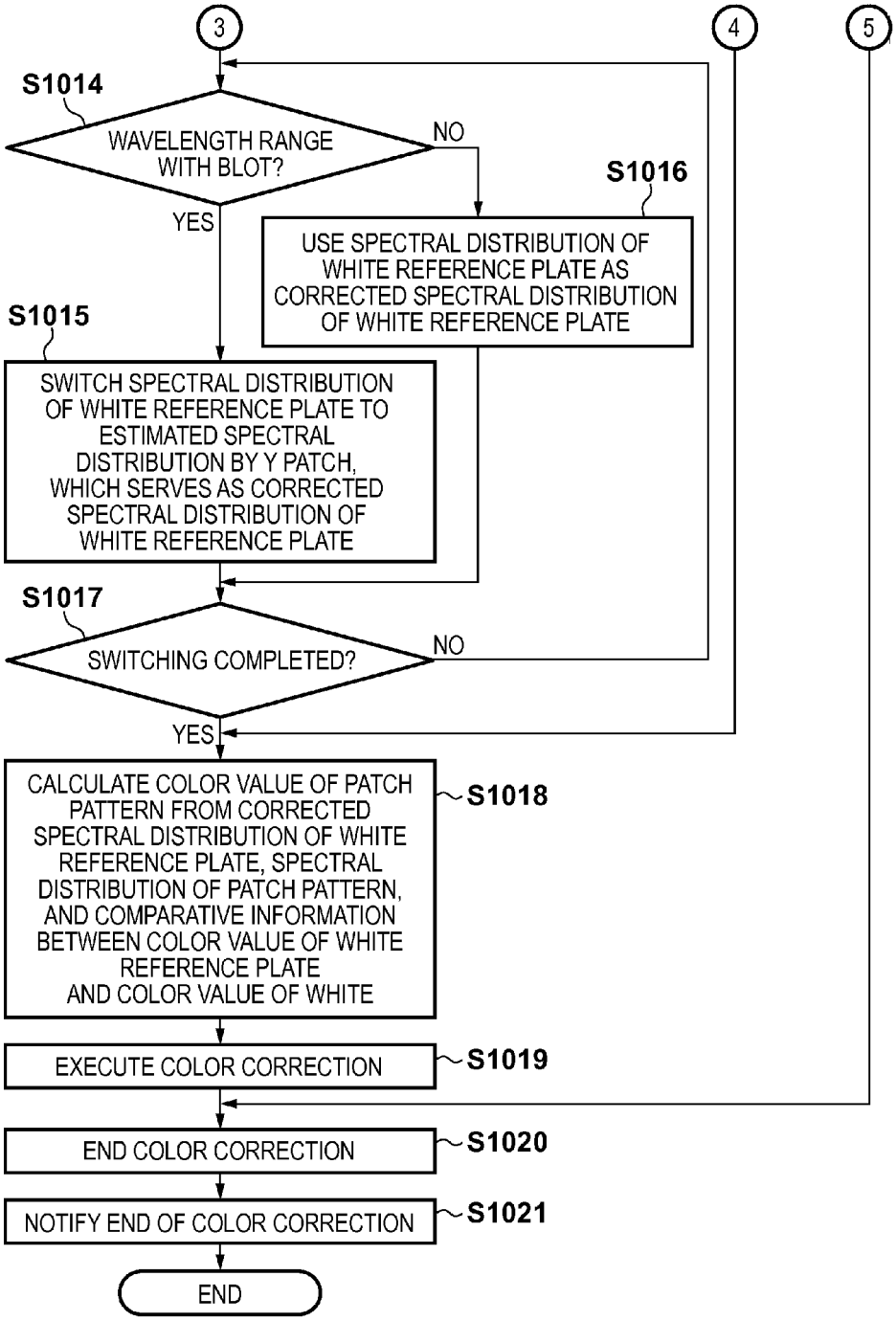

FIGS. 9A, 9B, and 9C illustrate a color correction sequence according to this embodiment. Upon receiving a color correction start instruction from the user (YES in step S1001), the CPU 60 instructs the ASIC 101 to start color correction so as to transfer the double transfer Y patch 23 and the color correction patch pattern 10 to the printing material 9 (step S1002). Upon receiving the color correction start instruction from the CPU 60, the white reference plate blot detection unit 102 in the ASIC 101 acquires the spectral distributions of the white reference plate 11, the double transfer Y patch 23, and the color correction patch pattern 10 using the color sensor 7 (step S1003). The white reference plate blot detection unit 102 calculates the estimated spectral distribution of the white reference plate 11 from the acquired spectral distribution of the double transfer Y patch 23, and the spectral distributions of the white reference plate 11 and the double transfer Y patch 23 at the time of shipment, which are stored in the ROM 100 (step S1004).

The white reference plate blot detection unit 102 determines whether the white reference plate 11 is blotted (step S1005). The white reference plate blot detection unit 102 compares the estimated spectral distribution of the white reference plate 11 with the acquired spectral distribution of the white reference plate 11 for each wavelength range. If there is at least one wavelength range where the difference is larger than the threshold Terr stored in the memory 35, the white reference plate 11 is determined to be blotted. If no blot exists (NO in step S1005), the white reference plate spectral distribution switching unit 103 uses the acquired spectral distribution of the white reference plate as the corrected spectral distribution of the white reference plate (step S1006).

If a blot exists (YES in step S1005), the white reference plate blot detection unit 102 compares the sum of the differences between the estimated spectral distribution of the white reference plate and the acquired spectral distribution of the white reference plate with the threshold Terr_low stored in the memory 35 (step S1007). If the sum of the differences is equal to or smaller than Terr_low (YES in step S1007), the white reference plate blot detection unit 102 notifies the user of a level 1 blot on the white reference plate 11 via the information notification unit 89 (step S1008). If the sum of the differences is equal to or larger than Terr_high (YES in step S1009), the white reference plate blot detection unit 102 notifies the user of a level 3 blot on the white reference plate 11 via the information notification unit 89 (step S1010). If the sum of the differences is larger than Terr_low and smaller than Terr_high (NO in step S1007 and NO in step S1009), the white reference plate blot detection unit 102 notifies the user of a level 2 blot on the white reference plate 11 via the information notification unit 89 (step S1011).

After the notification of the blot on the white reference plate 11, upon receiving a color correction end instruction from the user via the information input unit 88 (NO in step S1012), the CPU 60 instructs the white reference plate blot detection unit 102 in the ASIC 101 to end color correction so as to end the color correction (step S1020). The CPU 60 notifies the user of the end of color correction via the information notification unit 89 (step S1021).

When instructed by the user to continue color correction via the information input unit 88 and not to perform color correction using the estimated spectral distribution of the white reference plate estimated from the double transfer Y patch 23 (YES in step S1012 and NO in step S1013), the white reference plate spectral distribution switching unit 103 uses the acquired spectral distribution of the white reference plate as the corrected spectral distribution of the white reference plate (step S1006).

When instructed to perform color correction using the estimated spectral distribution of the white reference plate estimated from the double transfer Y patch 23 (YES in step S1013), the white reference plate spectral distribution switching unit 103 determines the presence/absence of a blot on the white reference plate for each wavelength range (step S1014). For a wavelength range with a blot (YES in step S1014), the white reference plate spectral distribution switching unit 103 switches the acquired spectral distribution of the white reference plate to the estimated spectral distribution of the white reference plate, which serves as the corrected spectral distribution of the white reference plate (step S1015). For a wavelength range without a blot (NO in step S1014), the white reference plate spectral distribution switching unit 103 uses the acquired spectral distribution of the white reference plate as the corrected spectral distribution of the white reference plate (step S1016).

After the switching (steps S1014 to S1016) has been completed for all wavelength ranges (YES in step S1017), the color value calculation unit 104 calculates the color value of the color correction patch pattern 10 from the corrected spectral distribution of the white reference plate, the acquired spectral distribution of the color correction patch pattern 10, and the preset ratio information between the color value of the white reference plate 11 and that of white (step S1018).

The image processing unit 81 executes color correction using a correction table generated by the correction table generation unit 87 based on the calculated color value of the color correction patch pattern 10 (step S1019). When the color correction has ended, the image processing unit 81 notifies the CPU 60 of the end of color correction. When notified of the end of color correction by the image processing unit 81, the CPU 60 instructs the white reference plate blot detection unit 102 in the ASIC 101 to end the color correction so as to end the color correction (step S1020). The CPU 60 notifies the user of the end of color correction via the information notification unit 89 (step S1021).

In this embodiment, after the spectral distributions of all patches of the color correction patch pattern 10 have been acquired, the corrected spectral distribution of the white reference plate 11 is calculated in the color correction sequence. However, the spectral distribution of the color correction patch pattern 10 may be acquired after the corrected spectral distribution of the white reference plate has been calculated. In this case, the color value of a patch may be calculated every time the spectral distribution of a patch of the color correction patch pattern 10 is acquired.

Performing the control of the embodiment allows to detect a blot on the white reference plate without using reference paper having a known color value. When the white reference plate is badly blotted, color correction can be performed without using the blotted white reference plate.

Note that in this embodiment, the Y patch is transferred to the printing material twice to detect a blot on the white reference plate. However, the number of times of transfer (number of times of superimposition) may be not two but three or more as long as a patch in a desired toner amount can be formed. The number of times of transfer may be one if the image forming apparatus is configured to transfer a toner sufficiently thick by one transfer. The method is not limited to the above-described method, and any other method may be used if a stable spectral distribution can be obtained.

Note that in this embodiment, the estimated spectral distribution of the white reference plate is obtained using the spectral distributions of the white reference plate and a patch serving as reference values detected in advance and the value of the spectral distribution of the patch detected by the color sensor at the time of correction. The estimated spectral distribution can be obtained by any other method if the reference value, the detection results, and the estimated value hold the relationship as shown in FIG. 6. That is, the estimated spectral distribution of the white reference plate may be obtained from the correlation relationship by the combination of the relationship (decrease rate) of the reference value and the estimated spectral distribution of the white reference plate and the relationship (decrease rate) of the reference value and the detection result of the patch. Alternatively, the estimated spectral distribution of the white reference plate may be calculated from the correlation relationship by the combination of the spectral distribution relationship (ratio) between the white reference plate and the patch for the reference value and the relationship (ratio) between the estimated spectral distribution of the white reference plate and the detection result of the patch.

In this embodiment, the blot on the white reference plate is detected using a Y patch. However, the blot on the white reference plate may be detected using a patch of another color (for example, C or M).

In this embodiment, when there is at least one wavelength range where the difference between the estimated spectral distribution of the white reference plate and the acquired spectral distribution of the white reference plate is larger than the threshold Terr, the white reference plate is determined to be blotted. However, the white reference plate may be determined to be blotted when the number of wavelength ranges where the difference is larger than the threshold Terr is larger than a preset number, or when the sum of the differences is larger than a preset value. In this case, the blot presence/absence determination threshold is also set so as to allow to determine a blot on the white reference plate when the difference between the color value calculated from the estimated spectral distribution of the white reference plate and the color value calculated from the spectral distribution of the white reference plate detected by the color sensor is equal to or larger than the color value detection accuracy of the color sensor. Note that the threshold used in the determination is the value of a light intensity for a color value or defined as a ratio.

In this embodiment, the degree of blot on the white reference plate is determined using the sum of the differences between the estimated spectral distribution of the white reference plate and the acquired spectral distribution of the white reference plate. However, the degree of blot on the white reference plate may be determined using the number of wavelength ranges where the difference is larger than the threshold Terr. In this case, values considering the influence of the number of wavelength ranges where the difference is larger than the threshold Terr on the difference between the color value calculated from the estimated spectral distribution of the white reference plate and the color value calculated from the spectral distribution of the white reference plate detected by the color sensor are set as the blot level determination thresholds, as in the embodiment. In this embodiment, three levels of blot are determined by blot level determination. However, the number of levels is not limited to this and may be larger for finer level determination. In addition, an operation to be executed may be presented for the user in accordance with the blot level.

In this embodiment, the acquired spectral distribution of the white reference plate is switched to the spectral distribution of the white reference plate estimated from the double transfer Y patch for only a wavelength range where a blot on the white reference plate is detected. However, the acquired spectral distribution of the white reference plate may be switched to the spectral distribution of the white reference plate estimated from the double transfer Y patch for all wavelength ranges.

In this embodiment, a spectral sensor capable of acquiring a light intensity for each wavelength range is used as the color sensor. However, the color sensor may be not a spectral sensor but any other sensor capable of calculating a density or a color value.

<Second Embodiment>

The second embodiment of the present invention will be described. An image forming apparatus and a color sensor according to the second embodiment have the same arrangements as those in the first embodiment, and a description thereof will be omitted. The second embodiment is different from the first embodiment in that blot detection and color correction of the white reference plate are performed using two types of patches, that is, Y patches and C patches which are transferred to both surfaces of a paper sheet.

Figure 10:
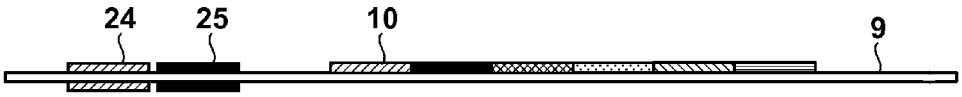
FIG. 10 is a view showing patches to be used to detect a blot on a white reference plate according to the second embodiment.

In this embodiment, blot detection and color correction of the white reference plate are performed using double-sided transfer Y patches 24 and double-sided transfer C patches 25 transferred to the same positions on both surfaces of a printing material 9, as shown in FIG. 10. Hence, patches of two colors Y and C (a plurality of types) are used. When conveyed once using switchback rollers 18 and discharge unit rollers 16 and 19 shown in FIG. 2, the printing material 9 can be turned once. Hence, the patches can be transferred to both surfaces of the printing material 9. To transfer the patches of the same type to the same position on both surfaces of the printing material 9, the Y patch and the C patch are transferred to the obverse surface of the printing material 9 in the order named, whereas the C patch and the Y patch are transferred to the reverse surface in the order named. In addition, to transfer the patches of the same type to the same position on both surfaces of the printing material 9, the transfer timing from the leading edge position of the printing material 9 until the patch is transferred is changed between the obverse surface and the reverse surface of the printing material 9. Transferring the patches to both surfaces of the printing material 9 enables to transfer a larger amount of toners than in one-time transfer on one surface. For this reason, the spectral distribution of each patch is hardly affected even when a paper sheet having a different color value, thinness, or toner fixing property is used. It is therefore possible to stably acquire the spectral distribution of the patch. In addition, the printing material 9 needs to be turned only once in the image forming apparatus. This makes it possible to shorten the color correction execution time as compared to a case in which a patch is transferred to the obverse surface of the printing material 9 twice.

[Blot Detection Method and Color Correction Method]

Figure 11A:
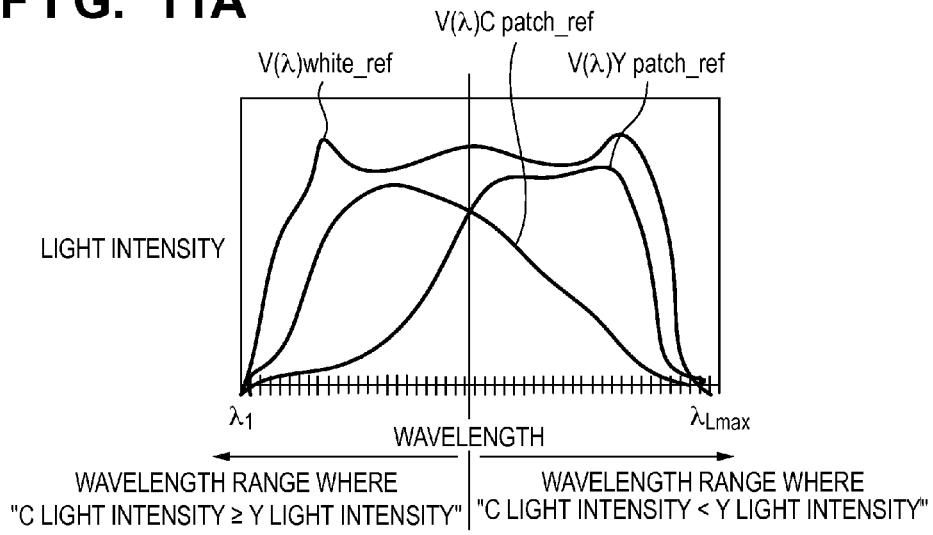
FIGS. 11A and 11B are graphs showing examples of the spectral distributions of the white reference plate and the patches according to the second embodiment when the white reference plate is blotted.

The blot detection method and color correction method of a white reference plate 11 according to this embodiment will be explained with reference to FIGS. 11A and 11B. In this embodiment, blot detection and color correction of the white reference plate 11 are performed using the two types of patches, that is, the double-sided transfer Y patch 24 and the double-sided transfer C patch 25. V(λ)white_ref, V(λ)Ypatch_ref, and V(λ)Cpatch_ref shown in FIG. 11A are the spectral distributions of the white reference plate 11, the double-sided transfer Y patch 24, and the double-sided transfer C patch 25 at the time of shipment of the image forming apparatus.

Figure 11B:
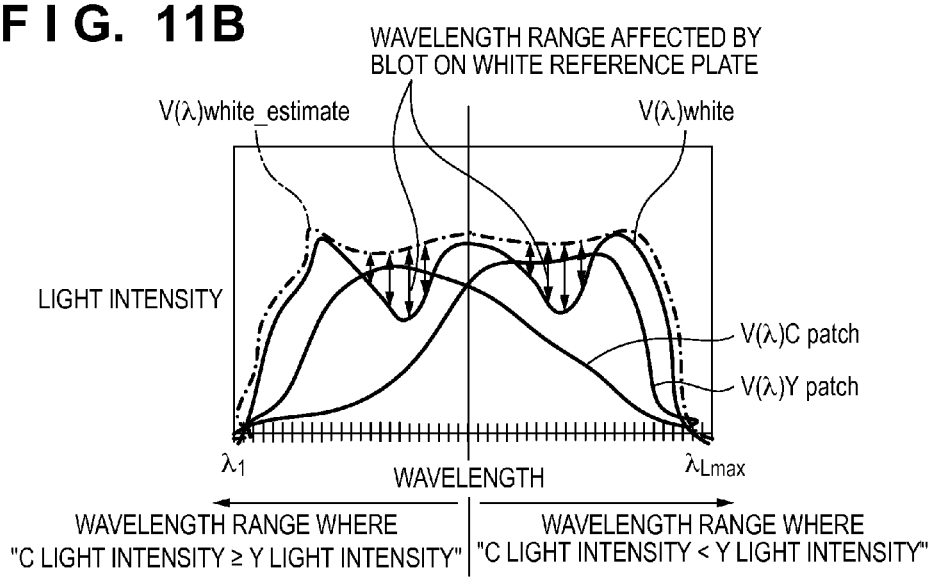

V(λ)white, V(λ)Ypatch, and V(λ)Cpatch shown in FIG. 11B are the spectral distributions of the blotted white reference plate 11, the double-sided transfer Y patch 24, and the double-sided transfer C patch 25 detected by a color sensor 7 with time degradation or toner adhesion at the time of color correction execution after shipment of the image forming apparatus. When time degradation, toner adhesion, or the like occurs in the color sensor 7 after shipment of the image forming apparatus, the light intensities of the spectral distributions of the white reference plate 11, the double-sided transfer Y patch 24, and the double-sided transfer C patch 25 lower, as shown in FIG. 11B.

However, if the decease in the light intensity is caused by the time degradation or toner adhesion of the color sensor 7, the spectral distributions of the white reference plate 11, the double-sided transfer Y patch 24, and the double-sided transfer C patch 25 are affected similarly. That is, when the white reference plate 11 is not blotted, the decrease rate from the spectral distribution at the time of shipment to the spectral distribution after shipment is the same for all of the white reference plate 11, the double-sided transfer Y patch 24, and the double-sided transfer C patch 25. Hence, if there is a wavelength range where the decrease rate from the spectral distribution of the white reference plate 11 at the time of shipment to the spectral distribution after shipment is higher than those for the double-sided transfer Y patch 24 and the double-sided transfer C patch 25, the white reference plate 11 can be determined to be blotted.

In this embodiment, out of the two types of patches, that is, the double-sided transfer Y patch 24 and the double-sided transfer C patch 25, a patch having a higher light intensity is selected for each wavelength range. A blot on the white reference plate 11 is detected by calculating an estimated spectral distribution V(λ)white_estimate of the white reference plate 11 from the selected patch using λ: wavelength range where "C light intensity≥Y light intensity"

$$V(\lambda)\text{white_estimate}=V(\lambda)\text{Cpatch}\times(V(\lambda)\text{white_ref}/V(\lambda)\text{Cpatch_ref})$$

λ: wavelength range where "C light intensity<Y light intensity"

$$V(\lambda)\text{white_estimate}=V(\lambda)\text{Ypatch}\times(V(\lambda)\text{white_ref}/V(\lambda)\text{Ypatch_ref}) \quad (6)$$

Using a patch which has a higher light intensity, that is, a patch which has a wider dynamic range of the light intensity detected by the color sensor 7 allows to reduce the estimation error in the estimated spectral distribution of the white reference plate. Hence, in this embodiment, a patch which has a higher light intensity is selected for each wavelength range. For example, when the white reference plate 11 is blotted by toner adhesion or the like, the light intensity may lower in some of the wavelength ranges of the spectral distribution. In this case, if it is possible to select a patch having a higher light intensity for each wavelength range, the estimated spectral distribution of the white reference plate with a small error can be obtained regardless of the wavelength range where the light intensity lowers due to the blot.

On the other hand, when the white reference plate 11 is blotted by dust adhesion or the like, the spectral distribution uniformly degrades independently of the wavelength range. Hence, the blot on the white reference plate 11 can properly be detected even using one type of patch, as in the first embodiment. The cause of the blot on the white reference plate 11, such as dust or toner, changes depending on the arrangement of the image forming apparatus. Hence, the types and number of blot detection patches are decided based on the arrangement of the image forming apparatus.

The estimated spectral distribution V(λ)white_estimate of the white reference plate is compared with the spectral distribution V(λ)white of the white reference plate detected by the color sensor 7 for each wavelength range. A wavelength range where the difference is larger than a blot determination threshold set in advance is determined to be affected by a blot on the white reference plate. As the blot determination threshold, a C patch blot presence/absence determination threshold Tc_err is selectively used for a wavelength range where the C patch light intensity is equal to or higher than the Y patch light intensity. A Y patch blot presence/absence determination threshold Ty_err is selectively used for a wavelength range where the Y patch light intensity is higher than the C patch light intensity.

λ: wavelength range where "C light intensity≥Y light intensity"

$$(V(\lambda)\text{white_estimate}-V(\lambda)\text{white})>\text{Tc_err}\rightarrow\text{the white reference plate is blotted}$$

$$(V(\lambda)\text{white_estimate}-V(\lambda)\text{white})>\text{Tc_err}\rightarrow\text{the white reference plate is not blotted}$$

λ: wavelength range where "C light intensity<Y light intensity"

$$(V(\lambda)\text{white_estimate}-V(\lambda)\text{white})>\text{Ty_err}\rightarrow\text{the white reference plate is blotted}$$

$$(V(\lambda)\text{white_estimate}-V(\lambda)\text{white})\leq\text{Ty_err}\rightarrow\text{the white reference plate is not blotted}$$

In this embodiment, the value of a wavelength range difference by which the difference between the color value calculated from the estimated spectral distribution of the white reference plate 11 and the color value calculated from the spectral distribution of the white reference plate 11 detected by the color sensor 7 becomes equal to or larger than the color value detection accuracy of the color sensor 7 is set as the blot presence/absence determination threshold. As the C patch blot presence/absence determination threshold Tc_err and the Y patch blot presence/absence determination threshold Ty_err, values that change depending on the developing unit are set in consideration of the manufacturing variation in the fixing property of the C patch and the Y patch to the printing material 9. In this embodiment, these thresholds are stored in each memory 35.

In this embodiment, if at least one wavelength range is affected by the blot, the user is notified of the blot on the white reference plate 11 and requested to replace or clean the white reference plate 11. In addition, the wavelength range-specific differences between the estimated spectral distribution V(λ)white_estimate of the spectral distribution of the white reference plate and the spectral distribution V(λ)white of the white reference plate 11 detected by the color sensor 7 are totaled, and the user is notified of the degree of blot on the white reference plate 11 in accordance with the magnitude of the sum.

In this embodiment, the user is notified of the degree of blot in three levels using C patch blot level determination thresholds Tc_err_high and Tc_err_low (Tc_err_high>Tc_err_low) and Y patch blot level determination thresholds Ty_err_high and Ty_err_low (Ty_err_high>Ty_err_low) set in advance.

level 1:

$$\Sigma(V(\lambda)\text{white_estimate}-V(\lambda)\text{white})\leq(\text{Tc_err_low}+\text{Ty_err_low})$$

level 2:

$$(\text{Tc_err_low}+\text{Ty_err_low})<\Sigma(V(\lambda)\text{white_estimate}-V(\lambda)\text{white})<(\text{Tc_err_high}+\text{Ty_err_high})$$

level 3:

$$(\text{Tc_err_high}+\text{Ty_err_high})\leq\Sigma(V(\lambda)\text{white_estimate}-V(\lambda)\text{white}) \quad (7)$$

where Σ is the sum at λ=λ1 to λLmax.

Values considering the influence of the sum of wavelength range-specific differences on the difference between the color value calculated from the estimated spectral distribution of the white reference plate and that calculated from the spectral distribution of the white reference plate detected by the color sensor 7 are set as the blot level determination thresholds. In addition, the blot level determination thresholds are set such that the values Tc_err_low+Ty_err_low and Tc_err_high+Ty_err_high become optimum thresholds. More specifically, as the blot level determination threshold, values considering the ratio of the wavelength range where "C light intensity≥Y light intensity" to the wavelength range where "C light intensity<Y light intensity" are set. For example, when the ratio of the wavelength range where "C light intensity≥Y light intensity" to the wavelength range where "C light intensity<Y light intensity" is 1:3, the blot level determination thresholds are set such that the ratio of Tc_err_low to Ty_err_low and that of Tc_err_high to Ty_err_high are also almost 1:3.

Assume that when, for example, the white reference plate is difficult to replace or clean, the user gives the instruction to perform color correction using the double-sided transfer Y patch 24 and the double-sided transfer C patch 25 in the state in which the white reference plate is blotted. In this case, color correction is done by switching the spectral distribution of the white reference plate detected by the color sensor 7 to the spectral distribution of the white reference plate estimated from the double-sided transfer Y patch 24 and the double-sided transfer C patch 25. At this time, for a wavelength range that is affected by the blot, a corrected spectral distribution V(λ)white_modify is calculated using the estimated spectral distribution V(λ)white_estimate of the white reference plate. For a wavelength range that is not affected by the blot, the corrected spectral distribution V(λ)white_modify is calculated using the spectral distribution V(λ)white of the white reference plate detected by the color sensor 7.

From the corrected spectral distribution V(λ)white_modify of the white reference plate 11 and the spectral distribution V(λ)patch of the color correction patch pattern 10 detected by the color sensor 7, a spectral distribution V(λ)patch_modify of the color correction patch pattern 10 detected by the color sensor 7 is calculated by $$V(\lambda)\text{patch_modify}=V(\lambda)\text{patch}\times(V(\lambda)\text{white_ref}/V(\lambda)\text{white_modify}) \quad (8)$$

The difference between the color value of the white reference plate 11 and the color value of white is corrected for the calculated corrected spectral distribution V(λ)patch_modify of the color correction patch pattern 10, thereby calculating the color value of the color correction patch pattern 10. With this control, when the white reference plate 11 is badly blotted, using the spectral distributions of the double-sided transfer Y patch 24 and the double-sided transfer C patch 25 enables to perform more accurate color correction than that using the blotted white reference plate 11.

[System Arrangement]

Figure 12:
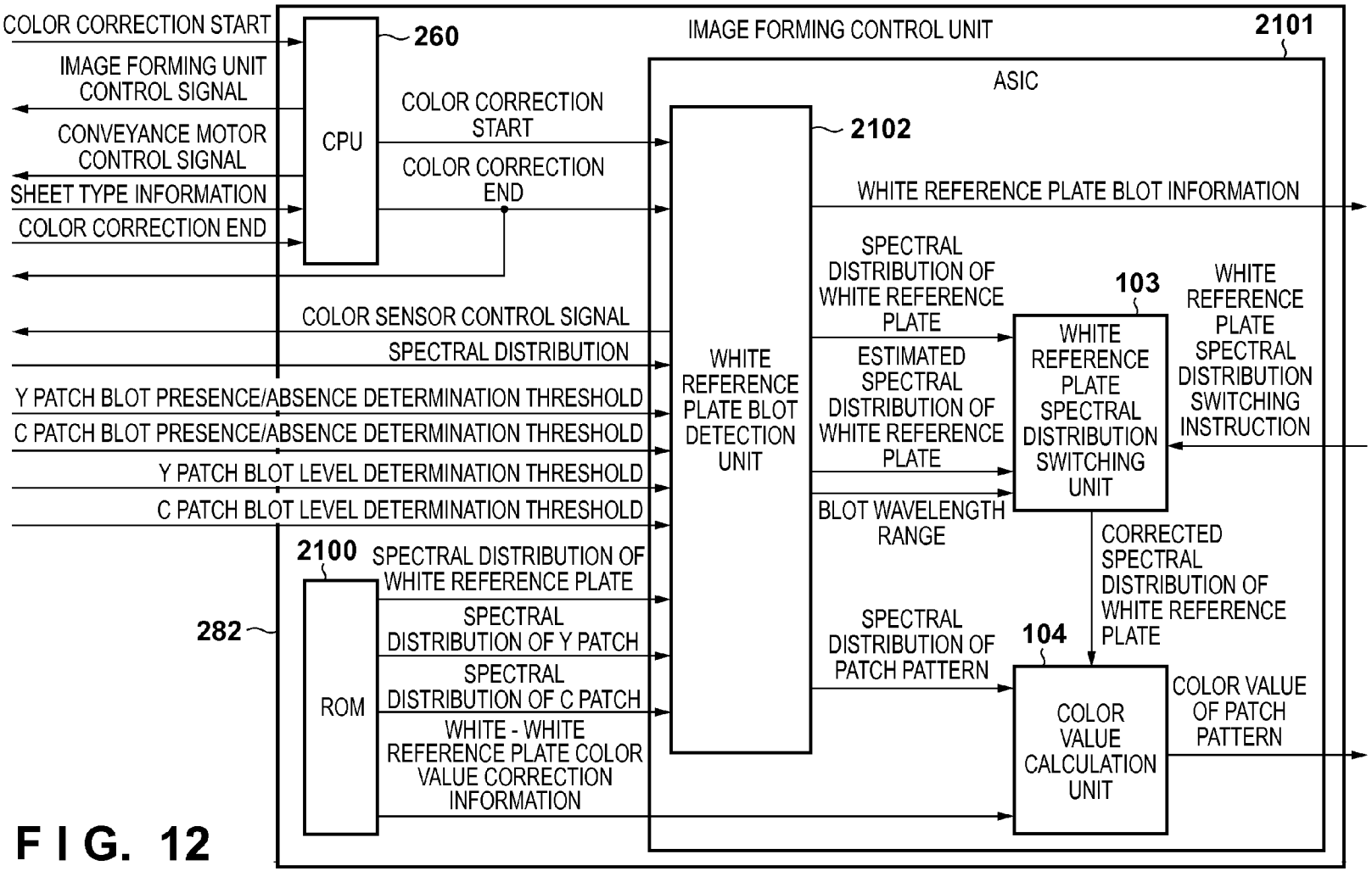
FIG. 12 is a block diagram of a color correction system according to the second embodiment.
Figure 13A:
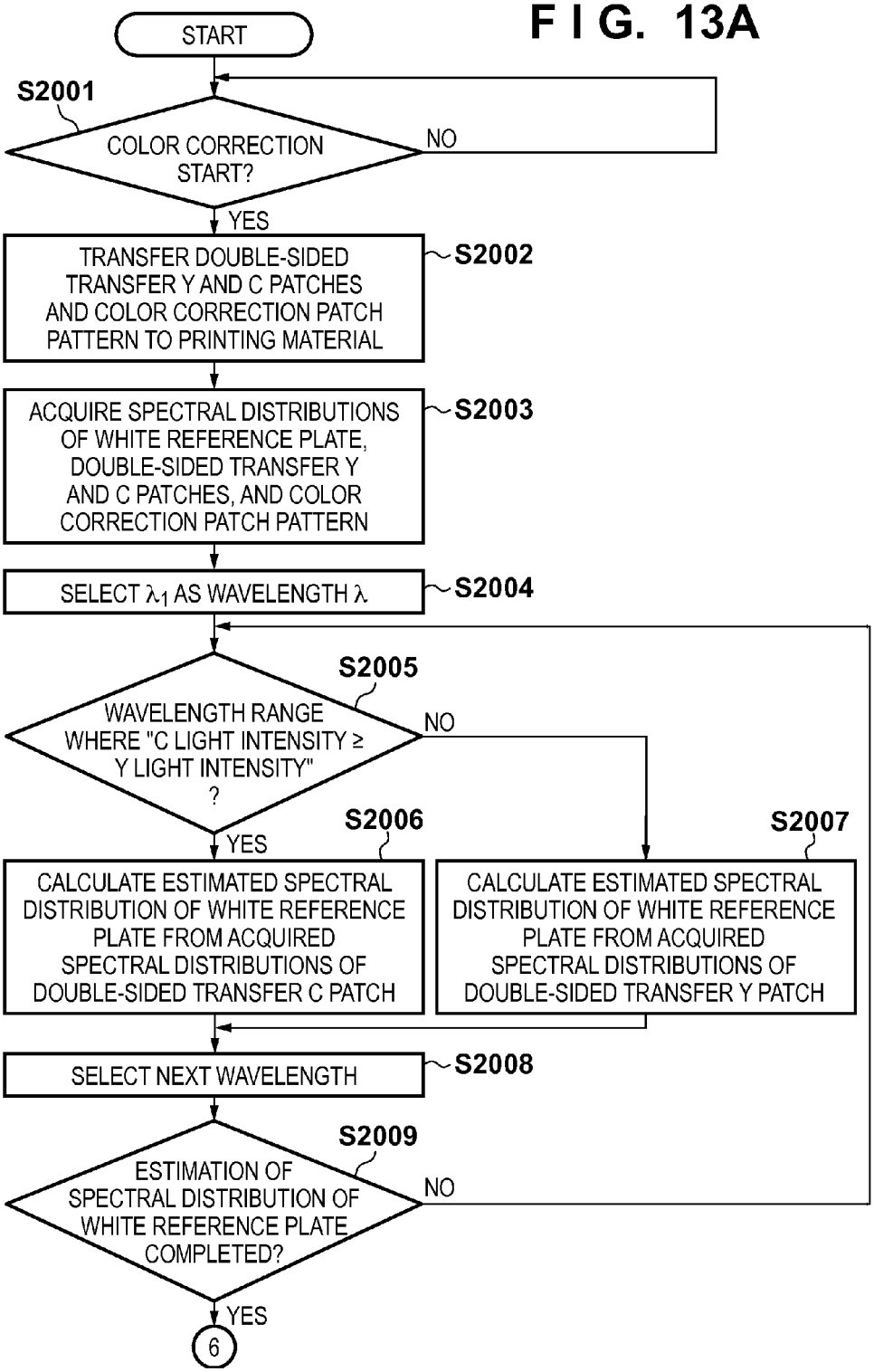
Figure 13B:
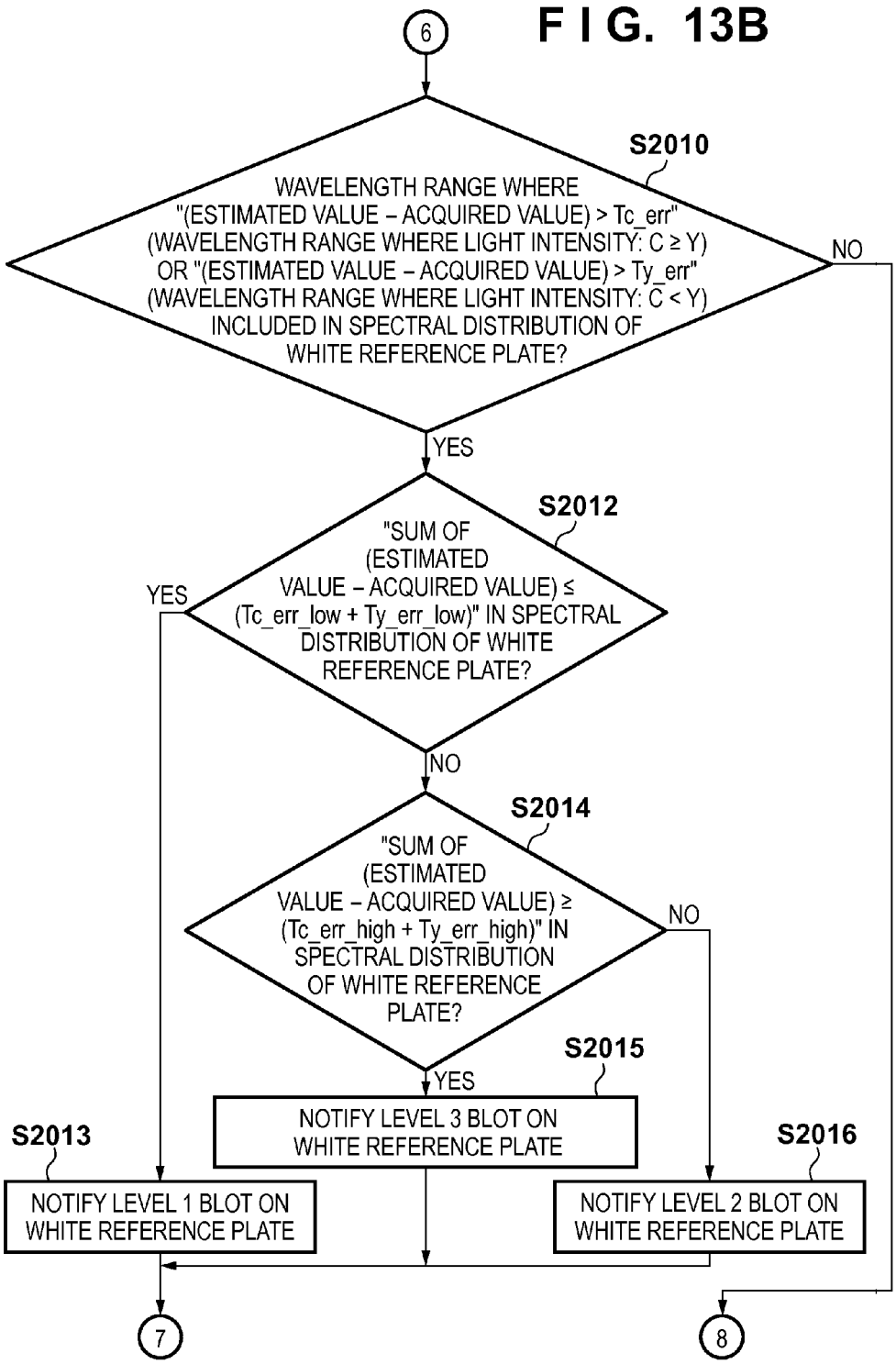
Figure 13D:
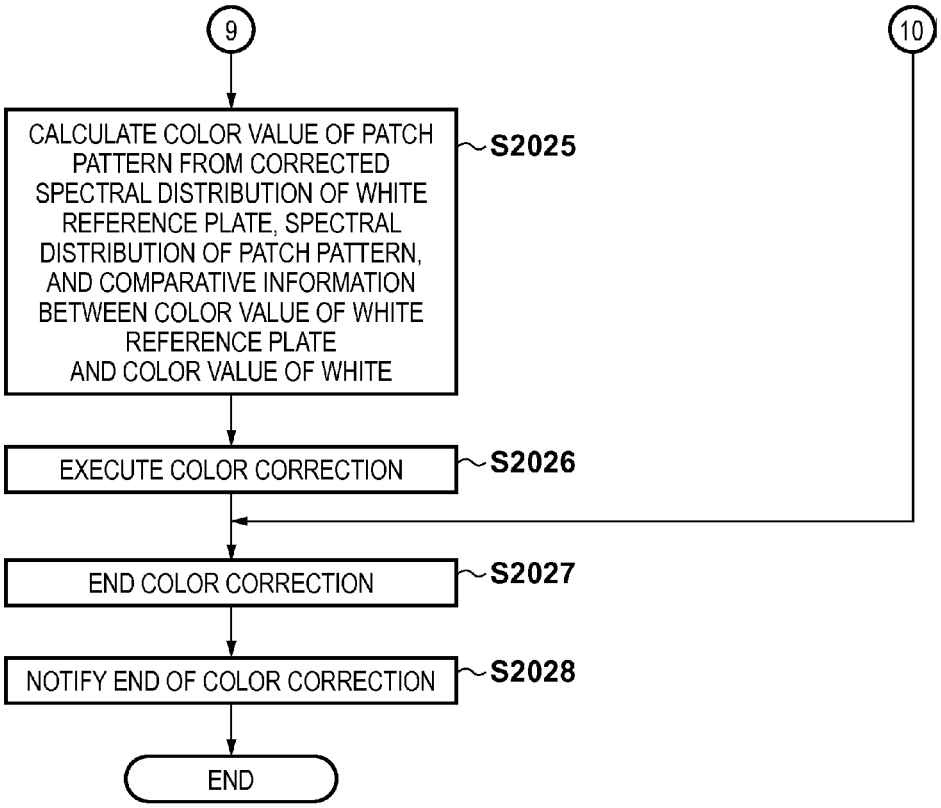

FIG. 12 is a block diagram of a color correction system according to this embodiment. Upon receiving a color correction start instruction via an information input unit 88, a CPU 260 of an image forming control unit 282 controls an image forming unit 3 and a conveyance motor 84 to form the double-sided transfer Y patches 24, the double-sided transfer C patches 25, and the color correction patch pattern 10 on the printing material 9.

Upon receiving the color correction start instruction from the CPU 260, a white reference plate blot detection unit 2102 in an ASIC 2101 controls the color sensor 7 to sequentially acquire the spectral distributions of the white reference plate 11, the double-sided transfer Y patch 24, the double-sided transfer C patch 25, and the color correction patch pattern 10. A ROM 2100 stores the spectral distributions of the white reference plate 11, the double-sided transfer Y patch 24, and the double-sided transfer C patch 25 detected by the color sensor 7 at the time of shipment of the image forming apparatus and information to be used to correct the difference between the color value of the white reference plate 11 and that of white.

The white reference plate blot detection unit 2102 receives the Y and C patch blot presence/absence determination thresholds Ty_err and Tc_err and the Y and C patch blot level determination thresholds Ty_err_high, Ty_err_low, Tc_err_high, and Tc_err_low. The values input here are stored in the memory 35 provided in each developing unit of image forming units 3Y and 3C shown in FIG. 2. The values consider the toner fixing property, manufacturing variation, and the like. The white reference plate blot detection unit 2102 calculates the estimated spectral distribution of the white reference plate 11 from the spectral distributions of the double-sided transfer Y patch and the double-sided transfer C patch detected by the color sensor 7 and the spectral distributions of the white reference plate 11, the double-sided transfer Y patch 24, and the double-sided transfer C patch 25 stored in the ROM 2100. The white reference plate blot detection unit 2102 determines the presence/absence of a blot on the white reference plate and the degree of blot based on the estimated spectral distribution of the white reference plate, the spectral distribution of the white reference plate detected by the color sensor 7, the blot presence/absence determination thresholds, and the blot level determination thresholds, and notifies the user of the white reference plate blot information via an information notification unit 89.

The white reference plate blot detection unit 2102 outputs the estimated spectral distribution of the white reference plate, the spectral distribution of the white reference plate detected by the color sensor 7, and the information of the wavelength ranges affected by the blot to a white reference plate spectral distribution switching unit 103. The user can determine whether to continue color correction based on the blot information of the white reference plate 11 notified by the information notification unit 89 and instruct the CPU 260 via the information input unit 88 to end or continue color correction.

To continue color correction, the user can instruct whether to switch the spectral distribution of the white reference plate detected by the color sensor 7 to the estimated spectral distribution of the white reference plate estimated from the double-sided transfer Y patch 24 and the double-sided transfer C patch 25 to execute color correction. This instruction can be input to the white reference plate spectral distribution switching unit 103 via the information input unit 88. Upon receiving the switching instruction, the white reference plate spectral distribution switching unit 103 outputs, for a wavelength range that is affected by the blot, the estimated spectral distribution of the white reference plate estimated from the double-sided transfer Y patch 24 and the double-sided transfer C patch 25 to a color value calculation unit 104 as the corrected spectral distribution of the white reference plate. In addition, for a wavelength range that is not affected by the blot, the white reference plate spectral distribution switching unit 103 outputs the spectral distribution of the white reference plate detected by the color sensor 7 to the color value calculation unit 104 as the corrected spectral distribution of the white reference plate. When no switching instruction is received, the white reference plate spectral distribution switching unit 103 outputs the spectral distribution of the white reference plate detected by the color sensor 7 to the color value calculation unit 104 as the corrected spectral distribution of the white reference plate.

The white reference plate blot detection unit 2102 outputs the spectral distribution of the color correction patch pattern 10 detected by the color sensor 7 to the color value calculation unit 104. The color value calculation unit 104 calculates the color value of the color correction patch pattern 10 from the corrected spectral distribution of the white reference plate output from the white reference plate spectral distribution switching unit 103, the spectral distribution of the patch pattern output from the white reference plate blot detection unit 2102, and the ratio information between the color value of the white reference plate 11 and that of white stored in the ROM 2100 in advance. The color value calculation unit 104 outputs the calculated color value to an image processing unit 81 shown in FIG. 3. The image processing unit 81 reflects the patch pattern color value on a correction table generation unit 87 and notifies the CPU 260 of the end of color correction. When notified of the end of color correction, the CPU 260 instructs the white reference plate blot detection unit 2102 to end color correction and notifies the user of the end of color correction via the information notification unit 89.

[Color Correction Processing]

FIGS. 13A, 13B, 13C, and 13D illustrate a color correction sequence according to this embodiment. Upon receiving a color correction start instruction from the user (YES in step S2001), the CPU 260 instructs the ASIC 2101 to start color correction so as to transfer the double-sided transfer Y patch 24, the double-sided transfer C patch 25, and the color correction patch pattern 10 to the printing material 9 (step S2002). Upon receiving the color correction start instruction from the CPU 260, the white reference plate blot detection unit 2102 in the ASIC 2101 acquires the spectral distributions of the white reference plate 11, the double-sided transfer Y patch 24, the double-sided transfer C patch 25, and the color correction patch pattern 10 using the color sensor 7 (step S2003).

The white reference plate blot detection unit 2102 selects λ1 as the wavelength λ (step S2004), and determines based on the spectral distributions of the double-sided transfer Y patch and the double-sided transfer C patch stored in the ROM 2100 which one of the light intensity of the Y patch and that of the C patch is higher (step S2005). If the light intensity of the C patch is equal to or higher than the light intensity of the Y patch (YES in step S2005), the white reference plate blot detection unit 2102 calculates the estimated spectral distribution of the white reference plate 11 (step S2006). In this case, the estimated spectral distribution is calculated from the acquired spectral distribution of the double-sided transfer C patch 25 and the spectral distributions of the white reference plate 11 and the double-sided transfer C patch 25 which are stored in the ROM 2100 at the time of shipment. If the light intensity of the Y patch is higher than the white reference plate spectral distribution switching unit of the C patch (NO in step S2005), the white reference plate blot detection unit 2102 calculates the estimated spectral distribution of the white reference plate 11 (step S2007). In this case, the estimated spectral distribution is calculated from the acquired spectral distribution of the double-sided transfer Y patch 24 and the spectral distributions of the white reference plate 11 and the double-sided transfer Y patch 24 which are stored in the ROM 2100 at the time of shipment.

The white reference plate blot detection unit 2102 selects the next wavelength (step S2008) and repeats the above-described processing (steps S2005 to S2008) until the calculation of the estimated spectral distribution of the white reference plate 11 is completed for all wavelength ranges. After the calculation of the estimated spectral distribution of the white reference plate 11 has been completed for all wavelength ranges (YES in step S2009), the white reference plate blot detection unit 2102 compares the estimated spectral distribution of the white reference plate 11 with the acquired spectral distribution of the white reference plate 11 for each wavelength range (step S2010). In this case, if there is at least one wavelength range where the difference between the acquired spectral distribution of the white reference plate and the estimated spectral distribution of the white reference plate is larger than a threshold stored in the memory of the developing unit, the white reference plate is determined to be blotted (YES in step S2010).

As the threshold, if the light intensity of the C patch is equal to or higher than the light intensity of the Y patch, the C patch blot presence/absence determination threshold Tc_err is selected. If the light intensity of the Y patch is higher than the light intensity of the C patch, the Y patch blot presence/absence determination threshold Ty_err is selected. If no blot exists (NO in step S2010), the white reference plate spectral distribution switching unit 103 uses the acquired spectral distribution of the white reference plate as the corrected spectral distribution of the white reference plate (step S2011).

If a blot exists (YES in step S2010), the white reference plate blot detection unit 2102 compares the sum of the differences between the estimated spectral distribution of the white reference plate 11 and the acquired spectral distribution of the white reference plate 11 with the sum "Tc_err_low+Ty_err_low" of the C and Y patch blot level determination thresholds stored in the memory of the developing unit (step S2012). If the sum of the differences is equal to or smaller than "Tc_err_low+Ty_err_low" (YES in step S2012), the white reference plate blot detection unit 2102 notifies the user of a level 1 blot on the white reference plate 11 via the information notification unit 89 (step S2013).

If the sum of the differences is equal to or larger than "Tc_err_high+Ty_err_high" (YES in step S2014), the white reference plate blot detection unit 2102 notifies the user of a level 3 blot on the white reference plate 11 via the information notification unit 89 (step S2015). If the sum of the differences is larger than "Tc_err_low+Ty_err_low" and smaller than "Tc_err_high+Ty_err_high" (NO in step S2012 and NO in step S2014), the white reference plate blot detection unit 2102 notifies the user of a level 2 blot on the white reference plate 11 via the information notification unit 89 (step S2016).

After the notification of the blot on the white reference plate 11, upon receiving a color correction end instruction from the user via the information input unit 88 (NO in step S2017), the CPU 260 instructs the white reference plate blot detection unit 2102 in the ASIC 2101 to end color correction so as to end the color correction (step S2027). The CPU 260 notifies the user of the end of color correction via the information notification unit 89 (step S2028).

When instructed by the user to continue color correction and not to perform color correction using the estimated spectral distribution of the white reference plate estimated from the double-sided transfer Y patch 24 and the double-sided transfer C patch 25 (YES in step S2017 and NO in step S2018), the white reference plate spectral distribution switching unit 103 uses the acquired spectral distribution of the white reference plate as the corrected spectral distribution of the white reference plate (step S2011). When instructed to perform color correction using the spectral distribution of the white reference plate estimated from the double-sided transfer Y patch 24 and the double-sided transfer C patch 25 (YES in step S2018), the white reference plate spectral distribution switching unit 103 selects λ1 as the wavelength λ (step S2019). The white reference plate spectral distribution switching unit 103 determines the presence/absence of a blot on the white reference plate (step S2020). For a wavelength range with a blot (YES in step S2020), the white reference plate spectral distribution switching unit 103 switches the acquired spectral distribution of the white reference plate to the estimated spectral distribution of the white reference plate, which serves as the corrected spectral distribution of the white reference plate (step S2021). For a wavelength range without a blot (NO in step S2020), the white reference plate spectral distribution switching unit 103 uses the acquired spectral distribution of the white reference plate as the corrected spectral distribution of the white reference plate (step S2022).

The white reference plate spectral distribution switching unit 103 selects the next wavelength (step S2023) and repeats the above-described processing (steps S2020 to S2023) until the switching is completed for all wavelength ranges. After the switching has been completed for all wavelength ranges (YES in step S2024), the color value calculation unit 104 calculates the color value of the color correction patch pattern 10 from the corrected spectral distribution of the white reference plate, the acquired spectral distribution of the patch pattern, and the preset ratio information between the color value of the white reference plate 11 and that of white (step S2025). The image processing unit 81 shown in FIG. 3 executes color correction using a correction table on which the calculated color value of the color correction patch pattern 10 is reflected by the correction table generation unit 87 (step S2026).

When the color correction has ended, the image processing unit 81 notifies the CPU 260 of the end of color correction.

When notified of the end of color correction by the image processing unit 81, the CPU 260 instructs the white reference plate blot detection unit 2102 in the ASIC 2101 to end the color correction so as to end the color correction (step S2027). The CPU 260 notifies the user of the end of color correction via the information notification unit 89 (step S2028).

In this embodiment, after the spectral distributions of all patches of the color correction patch pattern 10 have been acquired, the corrected spectral distribution of the white reference plate 11 is calculated in the color correction sequence. However, the spectral distribution of the color correction patch pattern 10 may be acquired after the corrected spectral distribution of the white reference plate has been calculated. In this case, the color value of a patch may be calculated every time the spectral distribution of a patch of the color correction patch pattern 10 is acquired.

Performing the control of the embodiment allows to accurately estimate the spectral distribution of the white reference plate even when the light intensity lowers in some wavelength ranges of the white reference plate due to toner adhesion or the like because a patch having a high light intensity is used for each wavelength range. In addition, the printing material needs to be turned only once when forming the patches on both surfaces of the printing material. This makes it possible to shorten the color correction execution time in comparison with a case in which a patch is transferred to one surface of the printing material twice.

In this embodiment, the blot on the white reference plate is detected using the Y patch and the C patch. However, the blot on the white reference plate may be detected using a plurality of patches by combining other colors (for example, M and K).

In this embodiment, when there is at least one wavelength range where the difference between the estimated spectral distribution of the white reference plate and the acquired spectral distribution of the white reference plate is larger than the threshold Tc_err or Ty_err, the white reference plate is determined to be blotted. However, the white reference plate may be determined to be blotted when the number of wavelength ranges where the difference is larger than the threshold Tc_err or Ty_err is larger than a preset number, or when the sum of the differences is larger than a preset value. In this case, the blot presence/absence determination thresholds are also set so as to allow to determine a blot on the white reference plate when the difference between the color value calculated from the estimated spectral distribution of the white reference plate and the color value calculated from the spectral distribution of the white reference plate detected by the color sensor is equal to or larger than the color value detection accuracy of the color sensor.

In this embodiment, the degree of blot on the white reference plate is determined using the sum of the differences between the estimated spectral distribution of the white reference plate and the acquired spectral distribution of the white reference plate. However, the degree of blot on the white reference plate may be determined using the number of wavelength ranges where the difference is larger than the threshold Tc_err or Ty_err. In this case, values considering the influence of the number of wavelength ranges where the difference is larger than the threshold Tc_err or Ty_err on the difference between the color value calculated from the estimated spectral distribution of the white reference plate and the color value calculated from the spectral distribution of the white reference plate detected by the color sensor are set as the blot level determination thresholds.

In this embodiment, the estimated spectral distribution of the white reference plate is calculated by selecting one patch from the two patches (Y and C) for each wavelength range. However, the white reference plate may be determined to be blotted when two or more estimated spectral distributions of the white reference plate are calculated using a plurality of patches (for example, Y, M, and C), and there is at least one estimated value for which the sum of the wavelength range-specific differences between the estimated spectral distribution and the acquired spectral distribution of the white reference plate is larger than the threshold. In this case, the blot presence/absence determination thresholds are also set so as to allow to determine a blot on the white reference plate when the difference between the color value calculated from the estimated spectral distribution of the white reference plate and the color value calculated from the spectral distribution of the white reference plate detected by the color sensor is equal to or larger than the color value detection accuracy of the color sensor.

In this embodiment, the acquired spectral distribution of the white reference plate is switched to the spectral distribution of the white reference plate estimated from the double-sided transfer Y patch and the double-sided transfer C patch for only a wavelength range where a blot on the white reference plate is detected. However, the acquired spectral distribution of the white reference plate may be switched to the spectral distribution of the white reference plate estimated from the double-sided transfer Y patch 24 and the double-sided transfer C patch 25 for all wavelength ranges.

In this embodiment, a spectral sensor capable of acquiring a light intensity for each wavelength range is used as the color sensor. However, any other sensor, such as an RGB sensor, is also usable.

<Third Embodiment>

The third embodiment of the present invention will be described. An image forming apparatus and a color sensor according to the third embodiment have the same arrangements as those in the first and second embodiments, and a description thereof will be omitted. In this embodiment, blot detection and color correction of the white reference plate are performed by changing the type of toner of the blot detection patch to be transferred, the number of times of transfer, and the obverse and reverse surfaces of a printing material to which the blot detection patch is to be transferred in accordance with the type of a printing material 9.

In this embodiment, a media sensor 14 notifies the CPU of the type of the printing material 9. The CPU changes the type of the white reference plate blot detection patch in accordance with the type of the printing material 9. The toner fixing property changes depending on the type of the printing material 9. Hence, transferring a patch in an optimum toner amount corresponding to the type of the printing material 9 makes it possible to shorten the color correction execution time and reduce the toner consumption.

In this embodiment, the CPU handles the table shown in FIG. 14. The table shown in FIG. 14 defines the condition of color correction corresponding to each paper type. More specifically, upon detecting the paper type No. 1, a Y patch is transferred to one surface of a paper sheet once. Upon detecting the paper type No. 2, two types of patches, that is, a Y patch and a C patch are transferred to each surface of a paper sheet once. Upon detecting the paper type No. 3, three types of patches, that is, a Y patch, an M patch, and a C patch are transferred to one surface of a paper sheet twice in a superimposed manner.

Upon detecting the paper type No. 4, two types of patches, that is, a Y patch and a patch formed by overlying C and M toners at the same portion are transferred to one surface of a paper sheet once. When two types of toners are overlaid at the same portion, the light intensity of the patch lowers, and a larger amount of toner can be transferred to the paper sheet. Hence, the spectral distribution of the patch can stably be acquired. In addition, since the patches can be superimposed twice without turning the paper sheet, the color correction execution time can be shortened. Note that in this embodiment, it is determined for the paper type No. 4 that an optimum color correction accuracy and execution time can be obtained by using the two types of patches; that is, a Y patch and a patch formed by overlying C and M toners at the same portion. Upon detecting the paper type No. 5, three types of patches, that is, a Y patch, an M patch, and a C patch are transferred to each surface of a paper sheet twice. In this embodiment, if the paper type cannot be specified, the same patches as those upon detecting the paper type No. 5 are transferred to the paper sheet.

In this embodiment, for a paper sheet having excellent toner fixing property, a patch with a small toner-bearing amount is selected. For rough paper, a sheet of glossy paper, or the like, a patch with a large toner-bearing amount is selected. When the patch to be transferred is changed based on the sheet of paper, color correction can be executed so that the color correction accuracy, the color correction execution time, and the toner consumption are optimized.

[System Arrangement]

Figure 15:
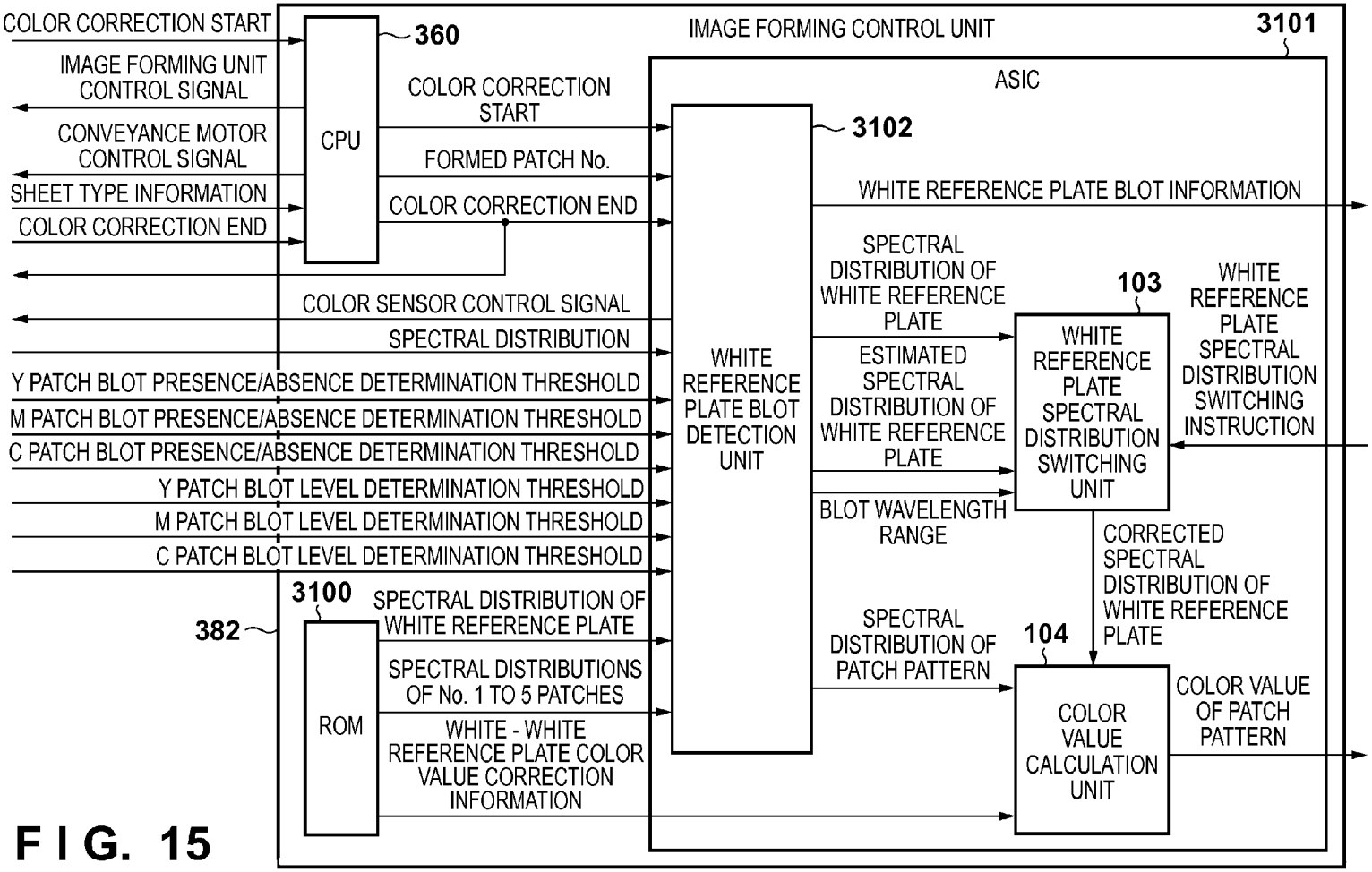
FIG. 15 is a block diagram of a color correction system according to the third embodiment.
Figure 17A:
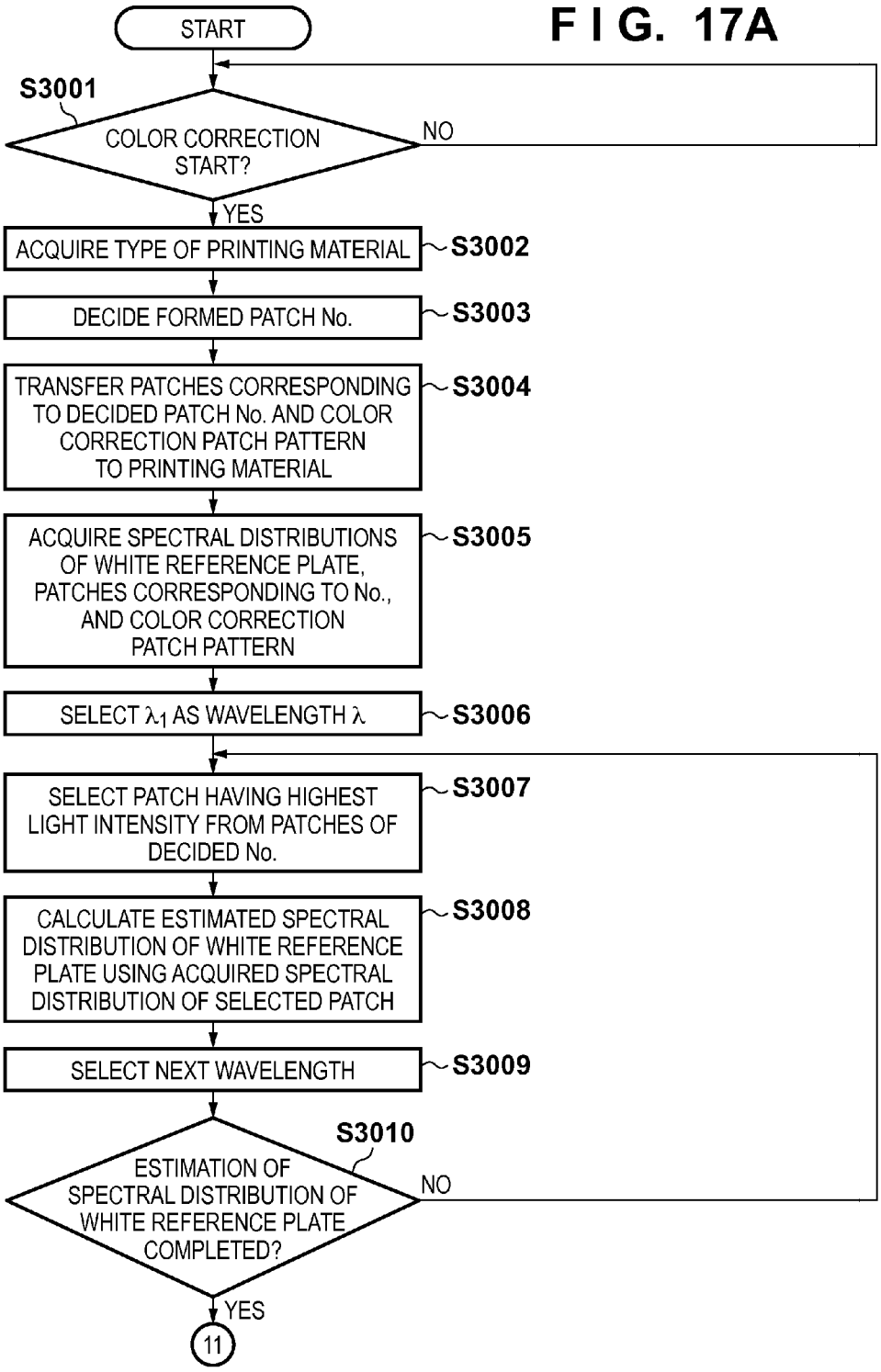
FIGS. 17A, 17B, 17C, and 17D are flowcharts of a color correction sequence according to the third embodiment.
Figure 17B:
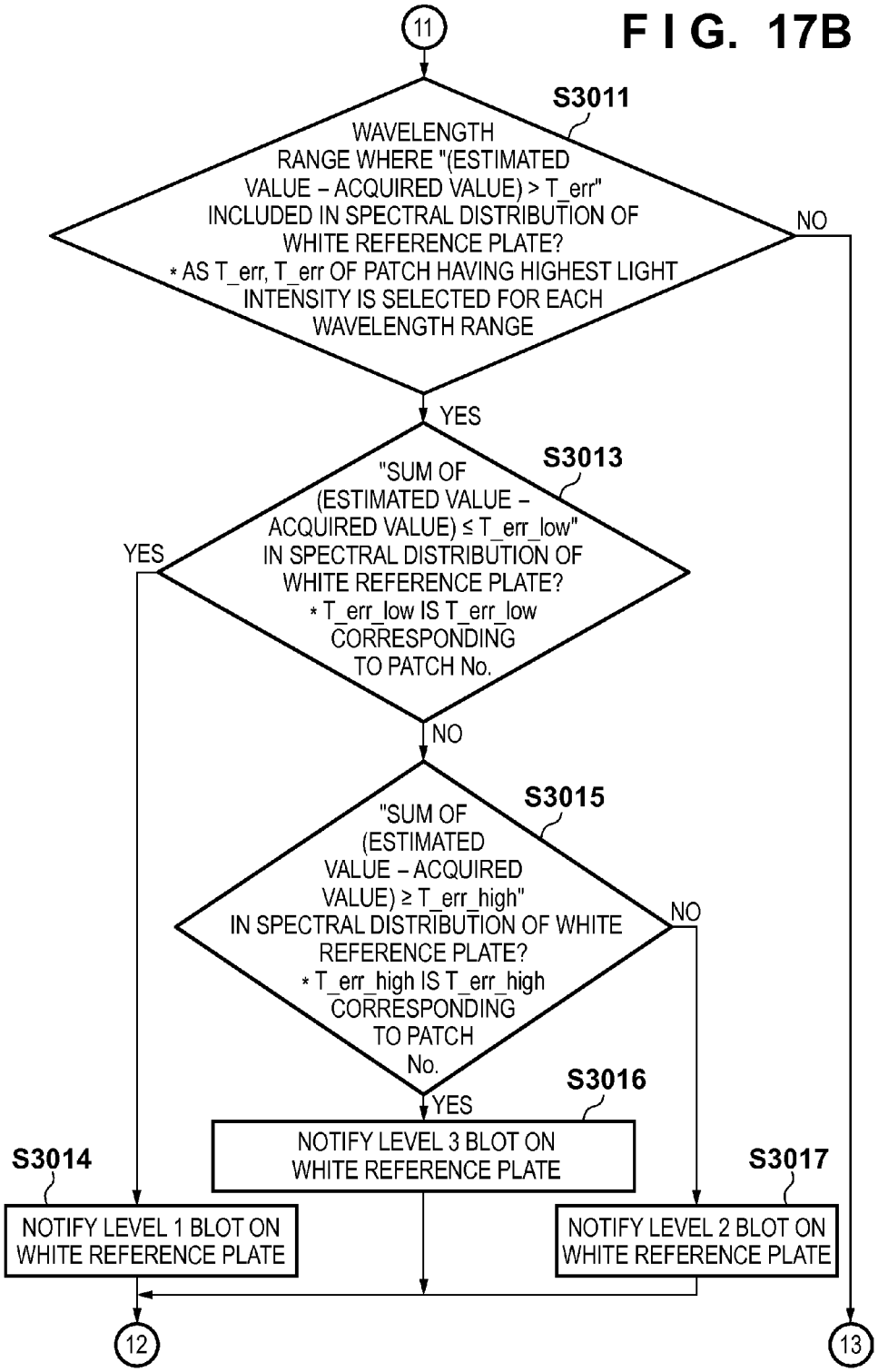
Figure 17C:
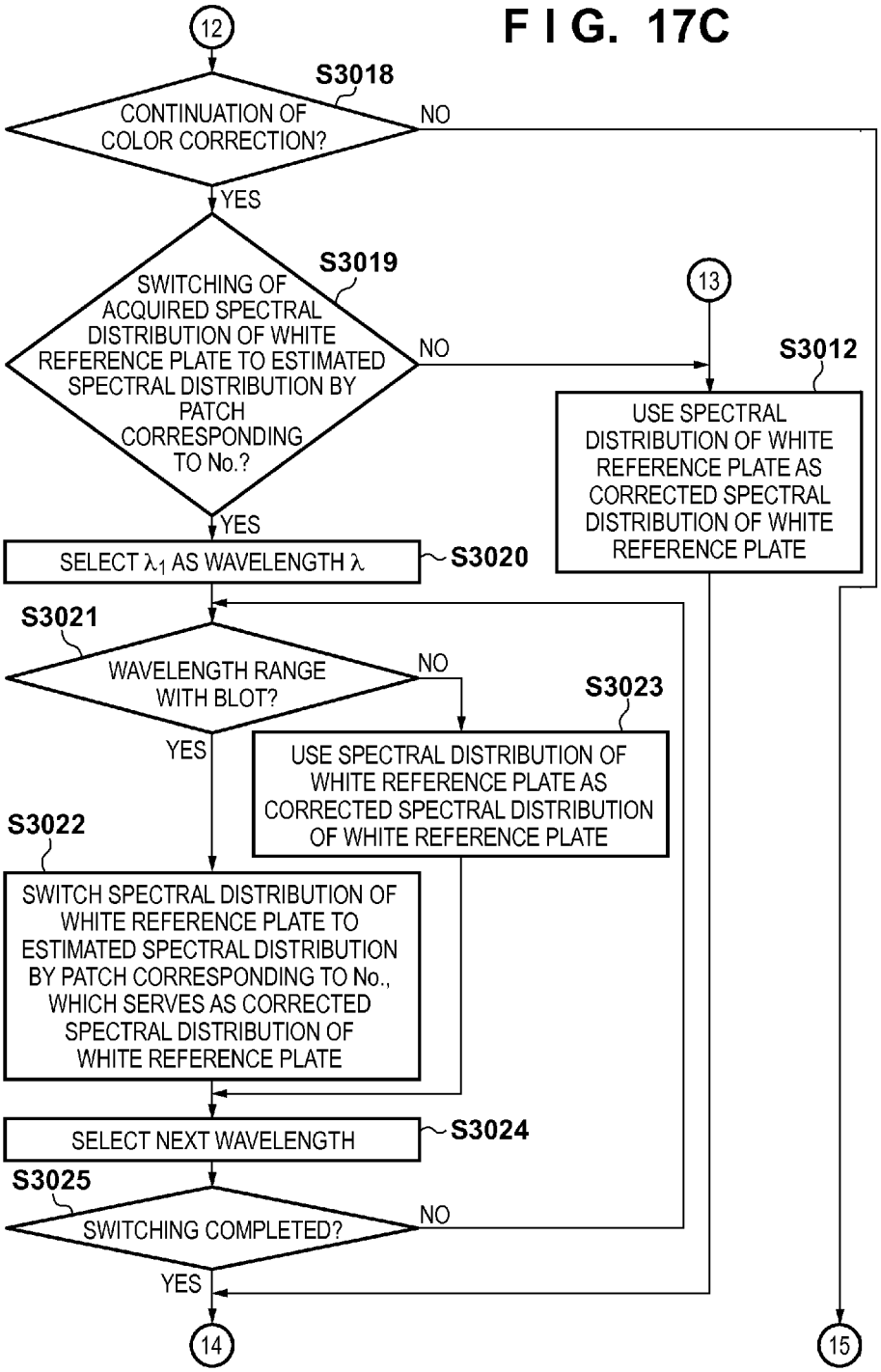
Figure 17D:
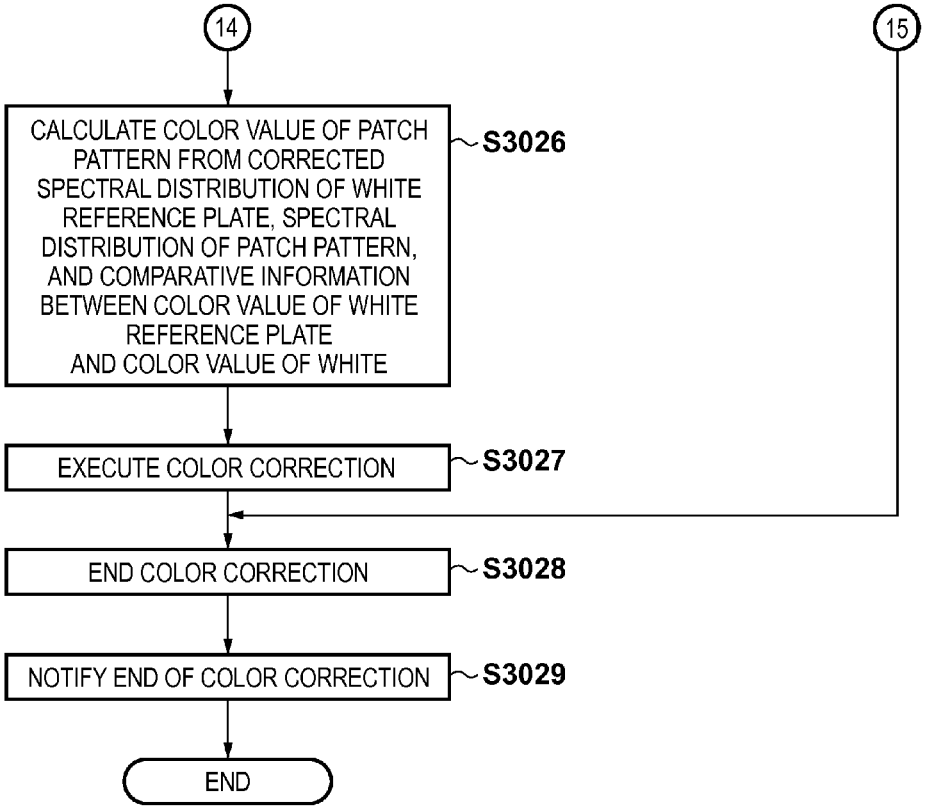

FIG. 15 is a block diagram of a color correction system according to this embodiment. Upon receiving a color correction start instruction from the user via an information input unit 88 shown in FIG. 3, a CPU 360 of an image forming control unit 382 acquires the type of the printing material 9 using the media sensor 14 and decides the formed patch No. based on the table shown in FIG. 14. The CPU 360 controls an image forming unit 3 and a conveyance motor 84 to form the patches corresponding to the decided patch No. and a color correction patch pattern 10 on the printing material 9. Upon receiving the color correction start instruction and the formed patch No. from the CPU 360, a white reference plate blot detection unit 3102 in an ASIC 3101 controls the color sensor to sequentially acquire the spectral distributions of a white reference plate 11, the patches corresponding to the patch No., and the color correction patch pattern 10.

A ROM 3100 stores the spectral distributions of the white reference plate 11 and the patches corresponding to the patch No. detected by a color sensor 7 at the time of shipment of the image forming apparatus and information to be used to correct the difference between the color value of the white reference plate 11 and that of white. The white reference plate blot detection unit 3102 receives Y, M, and C patch blot presence/absence determination thresholds Ty_err, Tm_err, and Tc_err and the T, M, and C patch blot level determination thresholds Ty_err_high, Ty_err_low, Tm_err_high, Tm_err_low, Tc_err_high, and Tc_err_low. The values input here are stored in the memory of the developing unit in each of image forming units 3Y, 3M, and 3C shown in FIG. 2. The values consider the toner fixing property, manufacturing variations, and the like.

In this embodiment, the value of a wavelength range difference by which the difference between the color value calculated from the estimated spectral distribution of the white reference plate 11 and the color value calculated from the spectral distribution of the white reference plate 11 detected by the color sensor becomes equal to or larger than the color value detection accuracy of the color sensor 7 is set as a blot presence/absence determination threshold. In addition, as the blot presence/absence determination threshold, a value that changes depending on the developing unit is set in consideration of the manufacturing variation in the fixing property of each patch to the printing material 9. Furthermore, values considering the influence of the sum of wavelength range-specific differences on the difference between the color value calculated from the estimated spectral distribution of the white reference plate and the color value calculated from the spectral distribution of the white reference plate detected by the color sensor 7 are set as the blot level determination thresholds.

The white reference plate blot detection unit 3102 corrects, in accordance with the patch No., the blot presence/absence determination thresholds and the blot level determination thresholds stored in the memory of each developing unit. In this embodiment, the values stored in the memory are directly used as thresholds for patches transferred once to one surface, as shown in FIG. 16. For the remaining double transfer patches, double-sided transfer patches, and the like, values obtained by multiplying the values stored in the memory by a preset correction coefficient $\alpha$ are used as the blot presence/absence determination threshold T_err and the blot level determination thresholds T_err_high and T_err_low.

The white reference plate blot detection unit 3102 calculates the estimated spectral distribution of the white reference plate from the spectral distributions of the patches corresponding to the patch No. detected by the color sensor 7 and the spectral distributions of the white reference plate 11 and the patches corresponding to the patch No. stored in the ROM 3100. In this embodiment, a patch which has a high light intensity is selected from a plurality of transferred patches for each wavelength range, thereby calculating the estimated spectral distribution of the white reference plate, as in the second embodiment. The white reference plate blot detection unit 3102 detects the presence/absence of a blot on the white reference plate and the degree of blot based on the estimated spectral distribution of the white reference plate, the spectral distribution of the white reference plate detected by the color sensor 7, the blot presence/absence determination thresholds, and the blot level determination thresholds. The white reference plate blot detection unit 3102 then notifies the user of the detected information as white reference plate blot information via an information notification unit 89 shown in FIG. 3.

The white reference plate blot detection unit 3102 outputs the estimated spectral distribution of the white reference plate, the spectral distribution of the white reference plate detected by the color sensor 7, and the information of the wavelength ranges affected by the blot to a white reference plate spectral distribution switching unit 103. The user can determine whether to continue color correction based on the blot information of the white reference plate 11 notified by the information notification unit 89 and instruct the CPU 360 via an information input unit 88 to end or continue color correction.

To continue color correction, the user can instruct the white reference plate spectral distribution switching unit 103 via the information input unit 88 whether to switch the spectral distribution of the white reference plate detected by the color sensor 7 to the estimated spectral distribution of the white reference plate to execute color correction. Upon receiving the switching instruction, the white reference plate spectral distribution switching unit 103 outputs, for a wavelength range that is affected by the blot, the estimated spectral distribution of the white reference plate estimated from the patches corresponding to the patch No. to a color value calculation unit 104 as the corrected spectral distribution of the white reference plate. In addition, for a wavelength range that is not affected by the blot, the white reference plate spectral distribution switching unit 103 outputs the spectral distribution of the white reference plate detected by the color sensor 7 to the color value calculation unit 104 as the corrected spectral distribution of the white reference plate. When no switching instruction is received, the white reference plate spectral distribution switching unit 103 outputs the spectral distribution of the white reference plate detected by the color sensor 7 to the color value calculation unit 104 as the corrected spectral distribution of the white reference plate.

The white reference plate blot detection unit 3102 outputs the spectral distribution of the color correction patch pattern 10 detected by the color sensor to the color value calculation unit 104. The color value calculation unit 104 calculates the color value of the color correction patch pattern 10 from the corrected spectral distribution of the white reference plate output from the white reference plate spectral distribution switching unit 103, the spectral distribution of the patch pattern output from the white reference plate blot detection unit 3102, and the ratio information between the color value of the white reference plate 11 and that of white stored in the ROM 3100 in advance. The color value calculation unit 104 outputs the calculated color value to an image processing unit 81 shown in FIG. 3.

The image processing unit 81 reflects the patch pattern color value on a correction table generation unit 87 and notifies the CPU 360 of the end of color correction. When notified of the end of color correction, the CPU 360 instructs the white reference plate blot detection unit 3102 to end color correction and notifies the user of the end of color correction via the information notification unit 89.

[Color Correction Processing]

FIGS. 17A, 17B, 17C, and 17D illustrate a color correction sequence according to this embodiment. Upon receiving a color correction start instruction from the user (YES in step S3001), the CPU 360 instructs the ASIC 3101 to start color correction and acquires the type of the printing material 9 using the media sensor (step S3002). The CPU 360 decides the formed patch No. based on the acquired type of the printing material 9 (step S3003). At this time, the CPU 360 decides the patch No. using the table shown in FIG. 14. The CPU 360 transfers the patches of the decided patch No. and the color correction patch pattern 10 to the printing material 9 (step S3004). Upon receiving the color correction start instruction from the CPU 360, the white reference plate blot detection unit 3102 in the ASIC 3101 acquires the spectral distributions of the white reference plate 11, the patches of the decided No., and the color correction patch pattern 10 using the color sensor 7 (step S3005).

The white reference plate blot detection unit 3102 selects λ1 as a wavelength λ (step S3006), and selects a patch having the highest light intensity from the patches of the decided No. (step S3007). The estimated spectral distribution of the white reference plate 11 is calculated from the spectral distribution of the selected patch acquired by the color sensor 7 and the spectral distributions of the white reference plate 11 and the patches corresponding to the patch No. stored in the ROM 3100 at the time of shipment (step S3008). The white reference plate blot detection unit 3102 selects the next wavelength (step S3009) and repeats the above-described processing (steps S3007 to S3009) until the calculation of the estimated spectral distribution of the white reference plate 11 is completed for all wavelength ranges.

After the calculation of the estimated spectral distribution of the white reference plate 11 has been completed for all wavelength ranges (YES in step S3010), the white reference plate blot detection unit 3102 determines the presence/absence of a blot on the white reference plate 11 (step S3011). In this case, the white reference plate blot detection unit 3102 compares the estimated spectral distribution of the white reference plate with the spectral distribution of the white reference plate acquired using the color sensor 7 for each wavelength range. If there is at least one wavelength range where the difference between the acquired spectral distribution of the white reference plate and the estimated spectral distribution of the white reference plate is larger than a blot presence/absence determination threshold, the white reference plate 11 is determined to be blotted. As the blot presence/absence determination threshold, a threshold is selected, which corresponds to the patch having the highest light intensity selected from the patches of the decided No. for each wavelength range. For example, when a patch of No. 2 in FIG. 16 is selected, T2y_err is selected as T_err for a wavelength range where the light intensity of the Y patch is highest. T2c_err is selected as T_err for a wavelength range where the light intensity of the C patch is highest.

If no blot exists (NO in step S3011), the white reference plate spectral distribution switching unit 103 uses the acquired spectral distribution of the white reference plate as the corrected spectral distribution of the white reference plate (step S3012). If a blot exists (YES in step S3011), the white reference plate blot detection unit 3102 compares the sum of the differences between the estimated spectral distribution of the white reference plate and the acquired spectral distribution of the white reference plate with the blot level determination thresholds corresponding to the decided No. (step S3013). For example, when a patch of No. 2 in FIG. 16 is selected, T2_err_low and T2_err_high are selected as T_err_low and T_err_high. When a patch of No. 3 is selected, T3_err_low and T3_err_high are selected as T_err_low and T_err_high. If the sum of the differences is equal to or smaller than T_err_low, the white reference plate blot detection unit 3102 notifies the user of a level 1 blot on the white reference plate 11 via the information notification unit 89 (step S3014). If the sum of the differences is equal to or larger than T_err_high (YES in step S3015), the white reference plate blot detection unit 3102 notifies the user of a level 3 blot on the white reference plate 11 via the information notification unit 89 (step S3016). If the sum of the differences is larger than T_err_low and smaller than T_err_high (NO in step S3013 and NO in step S3015), the white reference plate blot detection unit 3102 notifies the user of a level 2 blot via the information notification unit 89 (step S3017).

After the notification of the blot on the white reference plate 11, upon receiving a color correction end instruction from the user via the information input unit 88 (NO in step S3018), the CPU 360 instructs the white reference plate blot detection unit 3102 in the ASIC 3101 to end color correction so as to end the color correction (step S3028). The CPU 360 notifies the user of the end of color correction via the information notification unit 89 (step S3029).

When instructed by the user via the information input unit 88 to continue color correction (YES in step S3018), the process advances to step S3019. If color correction using the estimated spectral distribution of the white reference plate estimated from the patches corresponding to the patch No. is not instructed (NO in step S3019), the white reference plate spectral distribution switching unit 103 uses the acquired spectral distribution of the white reference plate as the corrected spectral distribution of the white reference plate (step S3012).

When instructed to perform color correction using the estimated spectral distribution of the white reference plate estimated from the patches corresponding to the patch No. (YES in step S3019), the white reference plate spectral distribution switching unit 103 selects λ1 as the wavelength λ (step S3020). The white reference plate spectral distribution switching unit 103 determines the presence/absence of a blot on the white reference plate (step S3021). For a wavelength range with a blot (YES in step S3021), the white reference plate spectral distribution switching unit 103 switches the acquired spectral distribution of the white reference plate to the estimated spectral distribution of the white reference plate, which serves as the corrected spectral distribution of the white reference plate (step S3022). For a wavelength range without a blot (NO in step S3021), the white reference plate spectral distribution switching unit 103 uses the acquired spectral distribution of the white reference plate as the corrected spectral distribution of the white reference plate (step S3023).

The white reference plate spectral distribution switching unit 103 selects the next wavelength (step S3024) and repeats the above-described processing (steps S3021 to S3024) until the switching is completed for all wavelength ranges. After the switching has been completed for all wavelength ranges (YES in step S3025), the color value calculation unit 104 calculates the color value of the color correction patch pattern 10 from the corrected spectral distribution of the white reference plate, the acquired spectral distribution of the patch pattern, and the preset ratio information between the color value of the white reference plate 11 and that of white (step S3026).

The image processing unit 81 executes color correction by reflecting the calculated color value of the color correction patch pattern 10 on the correction table generation unit 87 (step S3027). When the color correction has ended, the image processing unit 81 notifies the CPU 360 of the end of color correction. When notified of the end of color correction by the image processing unit 81, the CPU 360 instructs the white reference plate blot detection unit 3102 in the ASIC 3101 to end the color correction so as to end the color correction (step S3028). The CPU 360 notifies the user of the end of color correction via the information notification unit 89 (step S3029).

In this embodiment, after the spectral distributions of all patches of the color correction patch pattern 10 have been acquired, the corrected spectral distribution of the white reference plate is calculated in the color correction sequence. However, the spectral distribution of the color correction patch pattern 10 may be acquired after the corrected spectral distribution of the white reference plate has been calculated. In this case, the color value of a patch may be calculated every time the spectral distribution of a patch of the color correction patch pattern 10 is acquired.

Performing the control of the embodiment allows to select a patch in a toner amount capable of stably acquiring the spectral distribution in accordance with the type of the printing material. It is therefore possible to shorten the color correction execution time and reduce the toner consumption.

In this embodiment, five types of patch Nos. shown in FIG. 14 are used. However, the number of patch Nos. the formed patches, the number of times of transfer, and the transfer surfaces need not be the same as in this embodiment if it is possible to form patches suitable for a printing material that can be handled by the image forming apparatus to which the present invention is applied.

In this embodiment, the type of printing material is detected using a media sensor. However, the type of printing material may be detected based on information designated by the user via the information input unit.

In this embodiment, when there is at least one wavelength range where the difference between the estimated spectral distribution of the white reference plate and the acquired spectral distribution of the white reference plate is larger than the threshold T_err, the white reference plate is determined to be blotted. However, the white reference plate may be determined to be blotted when the number of wavelength ranges where the difference is larger than the threshold T_err is larger than a preset number, or when the sum of the differences is larger than a preset value. The blot presence/absence determination thresholds at this time are also set so as to allow to determine a blot on the white reference plate when the difference between the color value calculated from the estimated spectral distribution of the white reference plate and the color value calculated from the spectral distribution of the white reference plate detected by the color sensor is equal to or larger than the color value detection accuracy of the color sensor.

In this embodiment, the degree of blot on the white reference plate is determined using the sum of the differences between the estimated spectral distribution of the white reference plate and the acquired spectral distribution of the white reference plate. However, the degree of blot on the white reference plate may be determined using the number of wavelength ranges where the difference is larger than the threshold T_err. In this case, values considering the influence of the number of wavelength ranges where the difference is larger than the threshold T_err on the difference between the color value calculated from the estimated spectral distribution of the white reference plate and the color value calculated from the spectral distribution of the white reference plate detected by the color sensor are set as the blot level determination thresholds.

In this embodiment, the estimated spectral distribution of the white reference plate is calculated by selecting one patch from a plurality of patches corresponding to the patch No. for each wavelength range. However, the white reference plate may be determined to be blotted when two or more estimated spectral distributions of the white reference plate are calculated from a plurality of patches, and there is at least one estimated value for which the sum of the wavelength range-specific differences between the estimated spectral distribution and the acquired spectral distribution of the white reference plate is larger than the threshold. In this case, the blot presence/absence determination thresholds are also set so as to allow to determine a blot on the white reference plate when the difference between the color value calculated from the estimated spectral distribution of the white reference plate and the color value calculated from the spectral distribution of the white reference plate detected by the color sensor is equal to or larger than the color value detection accuracy of the color sensor.

In this embodiment, the acquired spectral distribution of the white reference plate is switched to the spectral distribution of the white reference plate estimated from the patches for only a wavelength range where a blot on the white reference plate is detected. However, the acquired spectral distribution of the white reference plate may be switched to the spectral distribution of the white reference plate estimated from the patches for all wavelength ranges.

In this embodiment, a spectral sensor capable of acquiring a light intensity for each wavelength range is used as the color sensor. However, the color sensor may be not a spectral sensor but any other sensor capable of calculating a density or a color value.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-146478, filed Jun. 30, 2011, which is hereby incorporated by reference herein in its entirety.

What is claimed is:

1. An image forming apparatus comprising:

a color detection unit constructed to emit a light to a color material on a printing material and a reference plate and to detect the light reflected by the color material and the reference plate;

a control unit constructed to correct an amount of the color material upon image forming based on a detection result of said color detection unit;

a storage unit constructed to store, in advance, the detection result of each of the color material and the reference plate detected by said color detection unit; and a blot detection unit constructed to estimate the detection result for the reference plate based on a relationship between a reference value of each of the color material and the reference plate stored in said storage unit and the detection result of the color material by said color detection unit, and in a case where a difference between the estimated detection result and the detection result of the reference plate by said color detection unit is larger than a predetermined value, to detect presence of a blot on the reference plate.

2. The apparatus according to claim 1, wherein upon detecting the presence of the blot, said blot detection unit detects a degree of blot on the reference plate using a plurality of thresholds for the difference.

3. The apparatus according to claim 1, wherein said blot detection unit detects the blot using one type of color material.

4. The apparatus according to claim 1, wherein said blot detection unit detects the blot using a plurality of types of color materials.

5. The apparatus according to claim 4, wherein when detecting the blot using the plurality of types of color materials, said blot detection unit estimates the detection result for the reference plate using a reference value of each of the plurality of types of color materials and the detection result by said color detection unit and detects the presence of the blot on the reference plate if there is at least one color material for which the difference between the estimated detection result and the detection result of the reference plate by said color detection unit is larger than the predetermined value.

6. The apparatus according to claim 5, wherein the predetermined value is set for each of the plurality of types of color materials.

7. The apparatus according to claim 1, wherein said color detection unit detects a light intensity of the color material transferred to the printing material for each wavelength range, and said blot detection unit detects the presence of the blot on the reference plate when one of a sum of wavelength range-specific differences between the estimated spectral distribution and the detection result of the reference plate by said color detection unit and the wavelength range-specific difference is larger than a predetermined value.

8. The apparatus according to claim 4, wherein said color detection unit detects a light intensity of the color material transferred to the printing material for each wavelength range, and said blot detection unit selects, from detection results of the plurality of types of color materials detected by said color detection unit, a detection result of a color material whose light intensity is higher than those of the remaining color materials for each wavelength range, and estimates the detection result for the reference plate using the detection result of the selected color material, and if the difference between the estimated detection result and the detection result of the reference plate by said color detection unit is larger than the predetermined value, detects the presence of the blot on the reference plate.

9. The apparatus according to claim 8, wherein said blot detection unit selects, from the detection results of the plurality of types of color materials detected by said color detection unit, not less than two detection results of color materials whose light intensities are higher than those of the remaining color materials for each wavelength range.

10. The apparatus according to claim 1, wherein said blot detection unit estimates the detection result of the reference plate by said color detection unit from a ratio of the detection result of the transferred color material by said color detection unit to the reference value of each of the color material and the reference plate stored in said storage unit, and the apparatus further comprises a calculation unit configured to calculate, using the estimated detection result, a correction value to be used to correct the amount of the color material to be transferred to the printing material.

11. The apparatus according to claim 10, wherein said color detection unit detects a light intensity of the color material transferred to the printing material for each wavelength range, and said calculation unit calculates the correction value using the estimated detection result for a wavelength range where said blot detection unit has detected the blot on the reference plate, and calculates the correction value using the detection result detected by said color detection unit for a wavelength range where no blot is detected.

12. The apparatus according to claim 1, wherein said storage unit stores, as the reference value in advance, the detection result of said color detection unit for the color material transferred to the same portion of the printing material a plurality of times in a superimposed manner, and said color detection unit detects, when correcting the amount of the color material, one of the density and the color value of the color material transferred to the same portion of the printing material the plurality of times in the superimposed manner.

13. The apparatus according to claim 1, wherein said storage unit stores, as the reference value in advance, the detection result of said color detection unit for the color material transferred to the same portion on both surfaces of the printing material, and said color detection unit detects, when correcting the amount of the color material, one of the density and the color value of the color material transferred to the same portion on the both surfaces of the printing material.

14. The apparatus according to claim 1, wherein said storage unit stores, as the reference value in advance, the detection result of said color detection unit for each of a plurality of types of color materials transferred to the printing material, and said color detection unit detects, when correcting the amount of the color material, one of the density and the color value of each of the plurality of types of color materials transferred to the printing material.

15. The apparatus according to claim 12, wherein a transfer timing of the color material to be transferred to the printing material and detected by said color detection unit is controlled in accordance with one of a transfer position and the number of times of superimposition.

16. The apparatus according to claim 12, wherein a type of the color material to be transferred to the printing material, a transfer position, and the number of times of superimposition at a time of detection by said color detection unit when correcting the amount of the color material are decided in accordance with a type of the printing material to which the color material is to be transferred.

17. The apparatus according to claim 1, further comprising a notification unit configured to notify information about the blot on the reference plate in accordance with the detection result detected by said blot detection unit.

18. A control method of an image forming apparatus comprising:

emitting a light to a color material on a printing material and a reference plate and detecting the light reflected by the color material and the reference plate by a color detection unit;

correcting an amount of the color material upon image forming based on a detection result of the color detection unit;

storing, in a storage unit in advance, the detection result of each of the color material and the reference plate detected by the color detection unit; and estimating the detection result for the reference plate based on a relationship between a reference value of each of the color material and the reference plate stored in the storage unit and the detection result of the color material by the color detection unit, and in a case where a difference between the estimated detection result and the detection result of the reference plate by the color detection unit is larger than a predetermined value, detecting presence of a blot on the reference plate.

19. An image forming apparatus comprising:

a color detection unit constructed to emit a light to a color material on a printing material and a reference plate and to detect the light reflected by the color material and the reference plate;

a control unit constructed to correct an amount of the color material upon image forming based on a detection result of the color detection unit;

a storage unit constructed to store, in advance, the detection result of each of the color material and the reference plate detected by the color detection unit; and an abnormal detection unit constructed to estimate the detection result for the reference plate based on a relationship between a reference value of each of the color material and the reference plate stored in the storage unit and the detection result of the color material by the color detection unit, and in a case where a difference between the estimated detection result and the detection result of the reference plate by the color detection unit is larger than a predetermined value, to detect presence of an abnormity on the reference plate.

20. A control method of an image forming apparatus comprising:

emitting a light to a color material on a printing material and a reference plate and detecting the light reflected by the color material and the reference plate by a color detection unit;

correcting an amount of the color material upon image forming based on a detection result of the color detection unit;

storing, in a storage unit in advance, the detection result of each of the color material and the reference plate detected by the color detection unit; and estimating the detection result for the reference plate based on a relationship between a reference value of each of the color material and the reference plate stored in the storage unit and the detection result of the color material by the color detection unit, and in a case where a difference between the estimated detection result and the detection result of the reference plate by the color detection unit is larger than a predetermined value, detecting presence of an abnormity on the reference plate.

* * * * *